US005207781A

United States Patent [19]

Röck

[11] Patent Number: 5,207,781

[45] Date of Patent: May 4, 1993

[54] CLOSING DEVICE FOR MOVING A DRAWER TO A FULLY INSERTED POSITION WITHIN A FURNITURE BODY

[75] Inventor: Erich Röck, Höchst, Austria

[73] Assignee: Julius Blum Gesellschaft m.b.H., Höchst, Austria

[21] Appl. No.: 876,903

[22] Filed: Apr. 30, 1992

Related U.S. Application Data

[63] Continuation of Ser. No. 738,355, Jul. 31, 1991, abandoned, which is a continuation-in-part of Ser. No. 504,136, Apr. 3, 1990, abandoned.

[30] Foreign Application Priority Data

| | | | |
|---|---|---|---|
| Apr. 3, 1989 | [AT] | Austria | 766/89 |
| Jul. 31, 1990 | [AT] | Austria | 1607/90 |
| Dec. 14, 1990 | [AT] | Austria | 2534/90 |

[51] Int. Cl.[5] ..... A47B 88/00

[52] U.S. Cl. ..... 312/319.1; 312/334.7

[58] Field of Search ..... 312/319.1, 330.1, 334.16, 312/348.1, 348.2, 333, 334.7

[56] References Cited

U.S. PATENT DOCUMENTS

| | | | |
|---|---|---|---|
| 1,238,514 | 8/1917 | Hartbeck . | |
| 1,241,093 | 9/1917 | Collings . | |
| 2,450,593 | 10/1948 | Hormes . | |
| 2,873,159 | 2/1959 | Becker . | |
| 3,055,724 | 9/1962 | Mazure . | |
| 3,836,222 | 9/1974 | Kuntze . | |
| 3,975,071 | 8/1976 | Quinn . | |
| 5,015,048 | 5/1991 | Brunnert | 312/319 |
| 5,040,858 | 8/1991 | Kruse et al. . | |
| 5,056,879 | 10/1991 | Rock et al. | 312/319 X |

FOREIGN PATENT DOCUMENTS

| | | |
|---|---|---|
| 0386731 | 9/1990 | European Pat. Off. . |
| 1262533 | 3/1968 | Fed. Rep. of Germany . |
| 3010089 | 9/1981 | Fed. Rep. of Germany . |
| 1117071 | 6/1968 | United Kingdom . |

*Primary Examiner*—Kenneth J. Dorner
*Assistant Examiner*—Gerald A. Anderson
*Attorney, Agent, or Firm*—Wenderoth, Lind & Ponack

[57] ABSTRACT

A closing device is employed in an article of furniture having furniture components including a furniture body and a drawer for moving the drawer to a fully inserted position within the furniture body. The closing device includes a pin member fixed to one of the furniture components and a tiltable member mounted on the other of the furniture components for displacement relative thereto in opposite first and second directions. The pin member and the tiltable members are engaged when the drawer is in the fully inserted position. Upon the drawer being moved in the direction outwardly of the furniture body, the tiltable member displaces relative to the other furniture component in the first direction. A spring acts on the tiltable member and the other furniture component to urge relative displacement therebetween in the second direction. When the pin and tiltable members are in engagement, the spring urges the drawer to move in a direction inwardly of the furniture body to the fully inserted position. When the tiltable member displaces relative to the other furniture component against the force of the spring means in the first direction to a predetermined relative position, the tiltable member is caused to tilt in a first pivot direction about an axis to a locking position whereat the tiltable member is locked to the other furniture component and engagement between the pin member and the tiltable member is released.

105 Claims, 25 Drawing Sheets

CLOSING DEVICE FOR MOVING A DRAWER TO A FULLY INSERTED POSITION WITHIN A FURNITURE BODY

This application is a continuation of application Ser. No. 07/738,355, filed Jul. 31, 1991 now abandoned, which is a continuation-in-part of application Ser. No. 07/504,136, filed Apr. 3, 1990, now abandoned.

BACKGROUND OF THE INVENTION

The present invention relates to a closing device, for use in an article of furniture having furniture components including a furniture body and a drawer slidable in opposite directions into and out of the furniture body, for moving the drawer to a fully inserted position within the furniture body. The present invention also relates to an article of furniture including the furniture body and the drawer and incorporating such closing device.

Modern drawers normally are provided with pull-out guide assemblies on each of opposite sides of the drawer, each such pull-out guide assembly including a supporting rail on the furniture body and a pull-out rail on the drawer. The pull-out guide assemblies are designed to ensure that the movement of the drawer into and out of the furniture body will be as easy and as smooth as possible. Conventionally, rollers, balls or slides are provided for transmitting the load of the drawer from the pull-out rails to the supporting rails of the furniture body. Such arrangements are adapted to the requirements of a particular drawer with respect to smoothness of operation and loading capacity.

It has been found that a drawer that has been moved to a closed position sometimes will not be in its fully closed or rear end position, i.e. fully inserted into the furniture body, such that a front plate or end of the drawer projects from the furniture body. As a result, it is possible for persons to bump against the front of the drawer, and consequently damage to the drawer or injury to such persons may occur. Projection of the front plate of the drawer from the front of the furniture body may occur when the drawer has been pushed into the furniture body without care or not to the full extent. Also, when the drawer has been pushed into the furniture body with too much energy, the drawer may again roll forwardly or rebound because of such excessive energy.

A closing device for a drawer is disclosed in British patent specification 1,117,071, wherein there is provided a tilting member or part which is movable between two end positions. The tilting member is acted upon by a coil spring and thereby is urged into respective of the end positions after having moved past a dead center position. The tilting member is fastened to a side wall of the furniture body, and the drawer is provided with a driving pin member which is inserted into a notch or slot in the tilting member during an end portion of the path of movement of the drawer. The driving pin member then moves the tilting member past the dead center position, whereupon the tilting member itself pulls the driving pin member and thus the drawer toward the rear of the furniture body under the action of the coil spring.

SUMMARY OF THE INVENTION

With the above discussion in mind, it is an object of the present invention to provide a closing device whereby it is possible to ensure that the drawer is pulled into the furniture body over a greater distance than is possible with the above known device. It is a further object of the present invention to provide such a closing device wherein the pull-in movement imparted to the drawer is as uniform as possible.

It is a yet further object of the present invention to provide a unit employable in such closing device and an improved article of furniture incorporating such closing device.

The above objects are achieved in accordance with one aspect of the present invention by providing a closing device, for use in an article of furniture having furniture components including a furniture body and a drawer slidable in opposite directions into and out of the furniture body, for moving the drawer to a fully inserted position within the furniture body. The closing device includes a first coupling or pin member adapted to be fixedly mounted on one of the furniture components, and a second coupling or tiltable member adapted to be mounted on the other of the furniture components for displacement relative thereto in opposite first and second directions. The pin member and the tiltable member are in engagement when the drawer is in the fully inserted position. As a result, there is caused, upon the drawer being moved in a direction outwardly of the furniture body, relative displacement in the first direction between the tiltable member and the other furniture component. Spring means acts on the tiltable member and on the other furniture component to urge relative displacement in the second direction between the tiltable member and the other furniture component. Thereby, when the pin member and the tiltable member are in engagement, the spring means urges the drawer to move in a direction inwardly of the furniture body to the fully inserted position. Upon relative displacement between the tiltable member and the other furniture component against the urging force of the spring in the first direction to a predetermined relative position, the tiltable member is caused to tilt in a first pivot direction about an axis to a locking position whereat the tiltable member is locked in position with respect to the other furniture component and whereat engagement between the pin member and the tiltable member is released. Thereafter, the drawer is freely movable into and out of the furniture body. Upon free movement of the drawer inwardly of the furniture body to a position whereat the pin member again engages with the tiltable member, the pin member tilts the tiltable member in a second pivot direction about the axis away from the locking position. At such time, the urging force of the spring again acts between the tiltable member and the other furniture component to cause relative displacement therebetween in the second direction and to move the drawer in the direction inwardly of the furniture body to the fully inserted position.

By such arrangement, it is possible to provide that the drawer is subjected to a pull-in movement over a substantial distance, and such distance readily may be adjusted and/or selected. Furthermore, the pull-in movement of the drawer will be substantially uniform.

In one arrangement of the present invention, the pin member may be mounted on the drawer, and the tiltable member may be mounted on the furniture body for movement relative thereto in the opposite first and second directions. In a preferred aspect of this embodiment of the present invention, the pin member is mounted on a pull-out rail of the drawer, and the tiltable member is mounted on the furniture body or on a supporting rail of the furniture body by means of a mounting arrangement. Such mounting arrangement may include a guide track defining a groove, with positioning means in the form of a pair of guide rods extending from the tiltable member into the groove and being guided thereby. The guide track includes a rectilinear portion and at least a forward arcuate portion. The tiltable member has therein a slot, and the pin member extends into the slot and is engaged with the tiltable member when the tiltable member is positioned along the rectilinear portion of the groove of the guide track. The pin member withdraws from the slot and thereby releases engagement between the pin member and the tiltable member upon movement of the tiltable member to the arcuate portion, thereby causing the tiltable member to tilt about the axis to the locked position. In accordance with a further feature of the present invention, the tiltable member is provided with a bendable or deformable catch that is bendable by contact of the pin member upon inward movement of the drawer and which has a configuration to be abutted by and pulled along by the pin member upon subsequent outward movement of the drawer. This makes it possible to correct a situation whereby the pin member and tiltable member unintentionally become disengaged at a position other than the predetermined locked position.

In accordance with a further embodiment of the present invention, the pin member may be mounted on the furniture body, and the tiltable member may be mounted on the drawer for movement relative thereto in the opposite first and second directions. In a particularly preferred arrangement of this embodiment of the present invention, the pin member is mounted on a supporting rail on the furniture body, and the tiltable member is mounted by mounting means on a pull-out rail of the drawer. Such mounting means may include a housing fixed to the pull-out rail and defining a rectilinear guide path or track, and a slide member slidable along the guide path in the opposite first and second directions. The tiltable member is pivoted to the slide member about the axis. The spring acts between the housing and the slide member, such that as the drawer is moved in the direction outwardly of the furniture body the housing moves outwardly with the pull-out rail and the pin member engages the tiltable member to prevent movement thereof outwardly, thereby deforming the spring. The housing has therein a recess at the predetermined relative position, and the tiltable member has extending therefrom a projection that extends into the recess upon the tiltable member tilting in the first pivot direction to the locked position. The tiltable member has therein a slot, and the pin member extends into the slot and is engaged with the tiltable member before the predetermined position of the recess. When the predetermined position is reached, the tiltable member pivots about h axis to the locked position whereat the projection extends into the recess. Accordingly, the pin member is withdrawn from the slot to thereby release engagement between the pin member and the tiltable member.

The pivot axis of the tiltable member may extend horizontally or vertically. Furthermore, the spring preferably is a helical spring and may be either of the type that is compressed upon movement of the tiltable member in the first direction and that expands to impart the urging force to the tiltable member, or of the type that is expanded upon movement of the tiltable member in the first direction and that retracts to impart the urging force to the tiltable member.

In accordance with a further aspect of the present invention, there is provided an article of furniture including a furniture body and a drawer, and further incorporating the above discussed closing device. In accordance with this aspect of the present invention, a closing device may be provided between the pull-out and supporting rails on each of opposite sides of the drawer, and the tiltable members and/or pin members on the opposite sides of the drawer may be offset with respect to each other in the direction of movement of the drawer into the furniture body. This allows pulling-in movement of the drawer over an even greater distance. Preferably, the supporting rail includes upper and lower horiztontal flanges, and each tiltable member is mounted on the respective lower horizontal flange.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
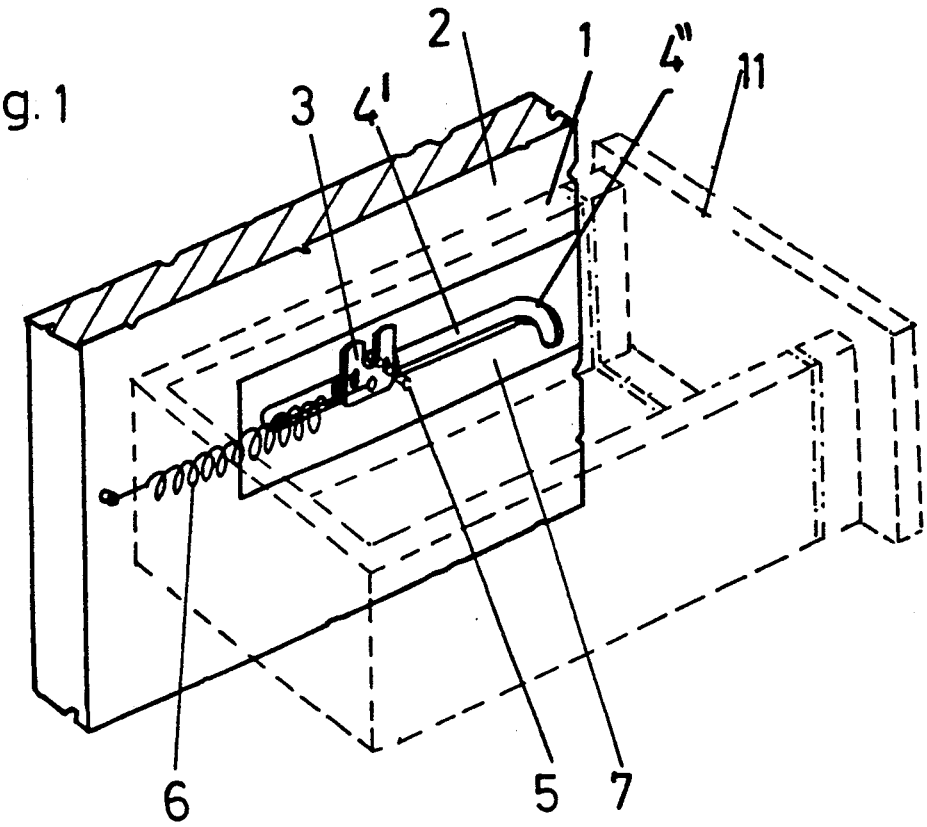
FIG. 1 is a perspective view illustrating a drawer, a furniture side wall and a closing device in accordance with a first embodiment of the present invention.

With reference to FIGS. 1-4, a first embodiment of the present invention will be described. Illustrated therein are portions of an article of furniture including a furniture body and a drawer. Only a side wall 2 of the furniture body is illustrated. The drawer includes opposite side walls 1 and a front plate 11. The drawer is slidable in opposite directions into and out of the furniture body. Such sliding movement is enabled by conventional means, for example pull-out guide assemblies mounted at each side of the drawer and including a supporting rail mounted on the furniture body side wall 2 and a pull-out rail mounted on the drawer side wall 1. Various carriages, rollers and/or balls may be provided between such rails to facilitate smooth movement of the drawer and to provide the function of bearing the load of the drawer.

A closing device in accordance with the present invention operates to ensure that the drawer is moved to a fully inserted closed position within the furniture body. Essential elements of this closing device according to the present invention are a coupling or tiltable member 3, a guide track 4, a driving coupling or pin member 5 and a spring 6, which preferably is in the form of a helical coil spring. In this embodiment of the present invention, the guide track 4 is formed by a groove defined in a rail member 7 fastened to body side wall 2. The driving pin member 5 is directly fastened to drawer side wall 1, or alternatively may be fastened to the pull-out rail of the drawer. As shown particularly in FIGS. 3 and 4, the tiltable member 3 is positioned in guide track 4 for movement there along by means of positioning elements in the form of a pair of guide rods 8 that extend from tiltable member 3 into guide track 4. Guide track 4 includes a rearwardly positioned and relatively long rectilinear portion 4' and a forwardly located arcuate portion 4" diverging laterally from the path of portion 4. Spring 6 has a first end connected to tiltable member 3 and a second end connected to the furniture body, for example furniture body side wall 2.

Figure 2:
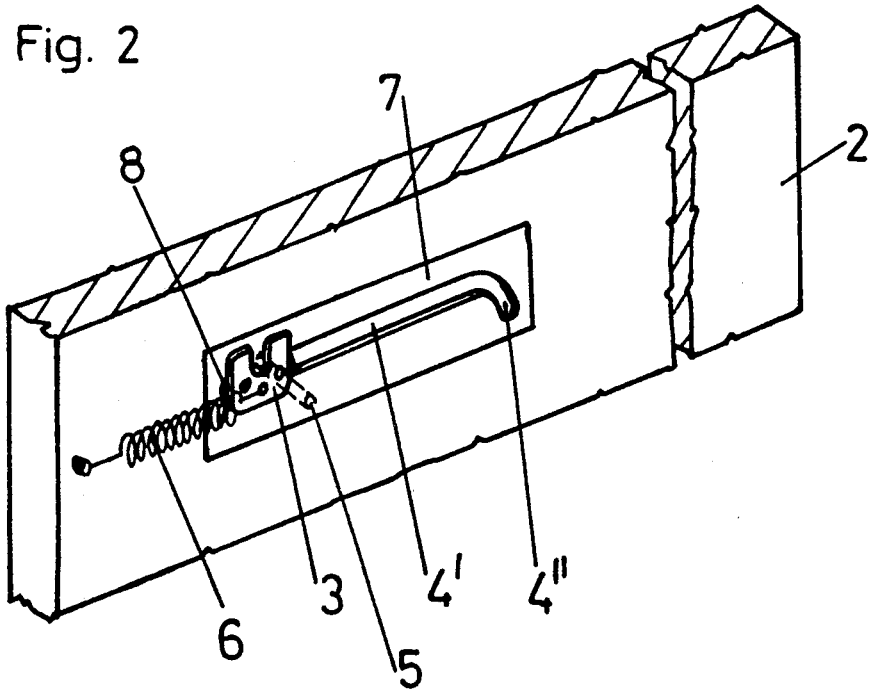
FIG. 2 is a perspective view, on an enlarged scale, of the furniture side wall and the elements of the closing device.
Figure 3:
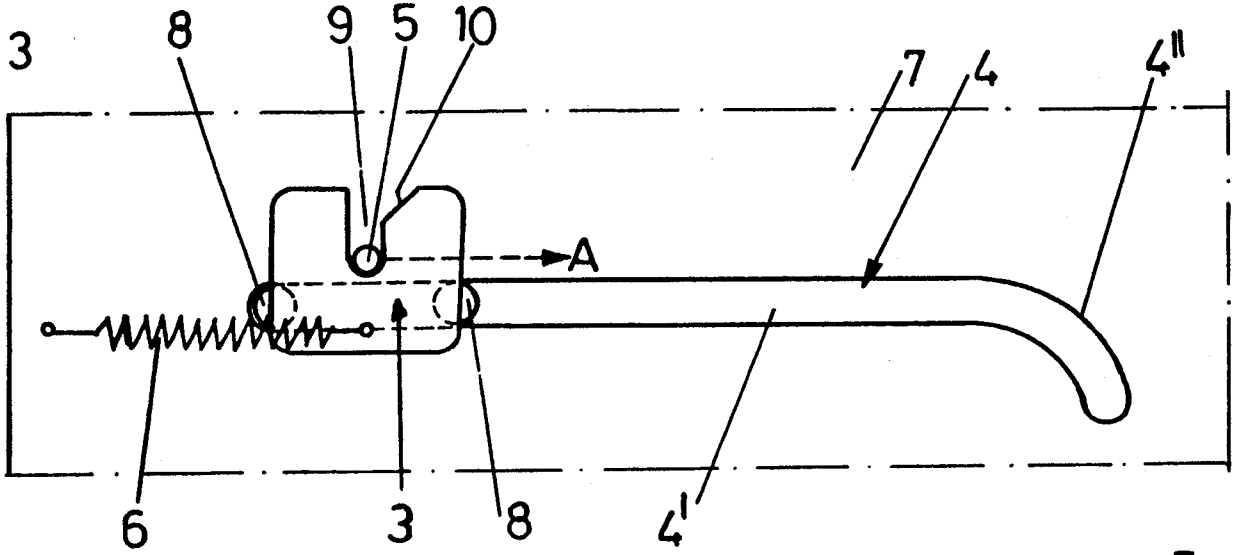
FIG. 3 is a side view of the elements shown in FIG. 2 as they appear in a closed position of the drawer.
Figure 4:
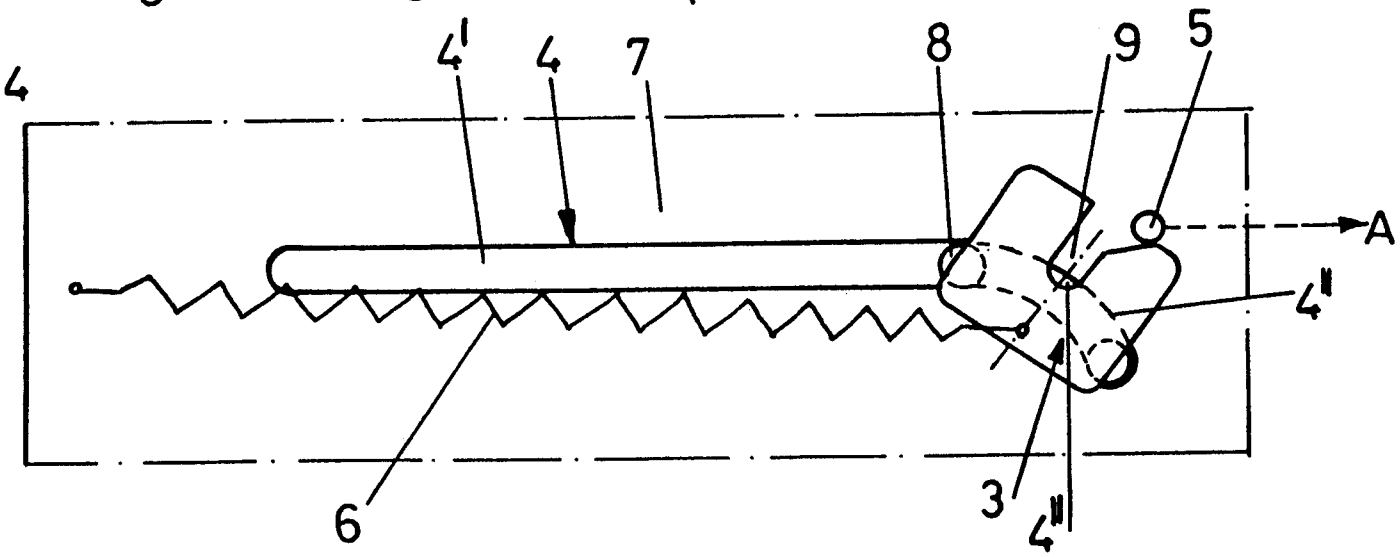
FIG. 4 is a view similar to FIG. 3 but showing the elements of the closing device in an extreme front position thereof wherein the drawer is opened.

The closing device of FIGS. 1-4 operates in the following manner. Thus, with the drawer in a fully inserted position within the furniture body, for example as illustrated in FIGS. 2 and 3, the spring 6 pulls on tiltable member 3 such that it is urged rearwardly of guide track 4. Tiltable member 3 has therein a catch slot 9 into which fits pin member 5 that is attached to the drawer. As a result, the tiltable meber 3 also pulls pin member 5 and the drawer rearwardly of the furniture body. Slot 9 has a forward, beveled side edge 10 to be discussed below. When the drawer is opened, pin member 5 pulls tiltable member 3 forwardly along guide track 4 in the direction of arrow A in FIG. 3. Thus, tiltable member 3 is displaceable relative to the furniture body in a forward first direction. This relative movement continues until a predetermined relative position determined by the arcuate portion 4". When pins 8 move into this arcuate portion, the tiltable member 3 tilts about an axis determined by leftmost pin 8 as seen in FIG. 4 or by the curvature of arcuate portion 4". As the drawer continues outward movement with tiltable member tilted into arcuate portion 4" as shown in FIG. 4, pin member 5 withdraws from slot 9 and rides over beveled edge 10. Thereafter, the drawer is freely movable into and out of the furniture body until pin member 5 again enters slot 9. Due to guiding provided by the two guide rods 8 and the dimensioning and curvature of the arc of arcuate portion 4", the tiltable member 3 is locked in the tilted forward position illustrated in FIG. 4. As such, the spring is prevented from pulling tiltable member 3 rearwardly. When the drawer then is to be inserted into the furniture body, it is freely moved rearwardly until pin member 5 again engages in slot 9 of tiltable member 3. The movement of the pin member 5 rearwardly into slot 9 releases tiltable member 3 from its locked position in arcuate portion 4". As soon as the tiltable member substantially returns to rectilinear portion 4' of guide track 4, the force of spring 6 thereby is allowed to pull tiltable member 3 rearwardly. Accordingly, the spring 6 pulls the tiltable member 3 and thereby the pin member 5 and the drawer rearwardly into the furniture body. In this manner, the drawer is pulled into a fully inserted position within the furniture body, even if the drawer was not carefully pushed into the furniture body. As such, the front plate 11 of the drawer does not project outwardly from the furniture body.

Figure 5:
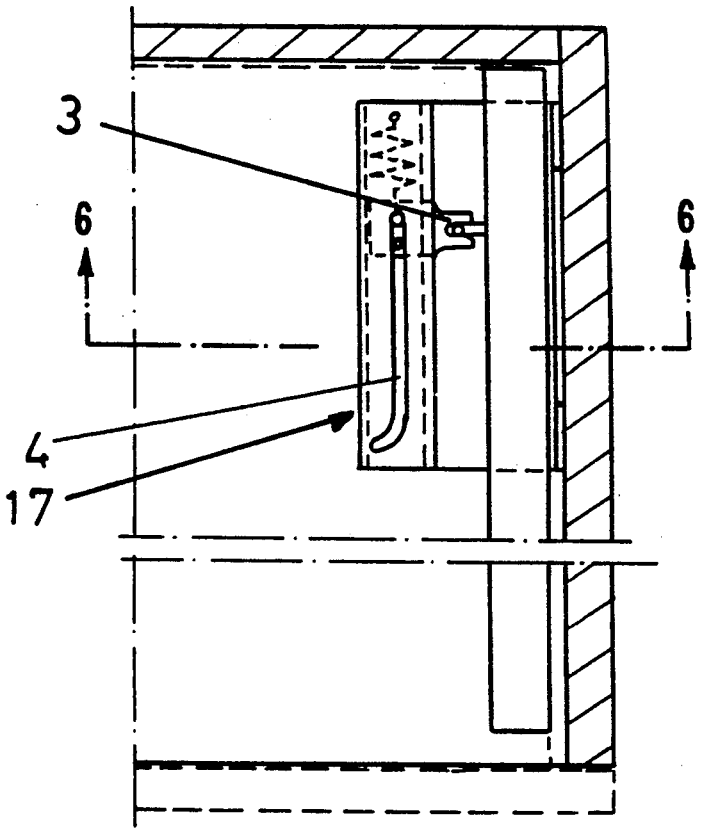
FIG. 5 is a view from below of a drawer and a closing device according to another embodiment of the present invention.
Figure 6:
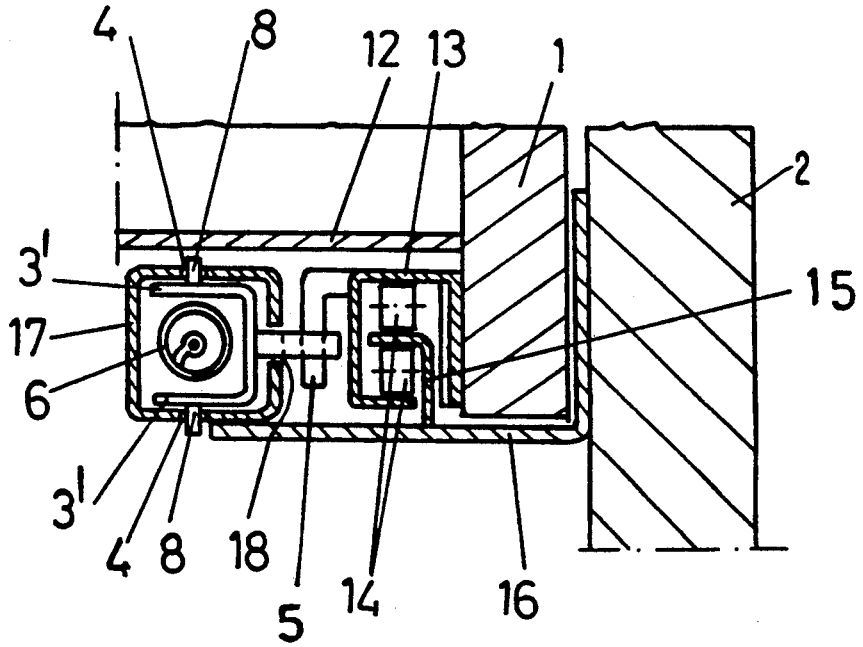
FIG. 6 is a sectional view taken along line 6—6 of FIG. 5.
Figure 7:
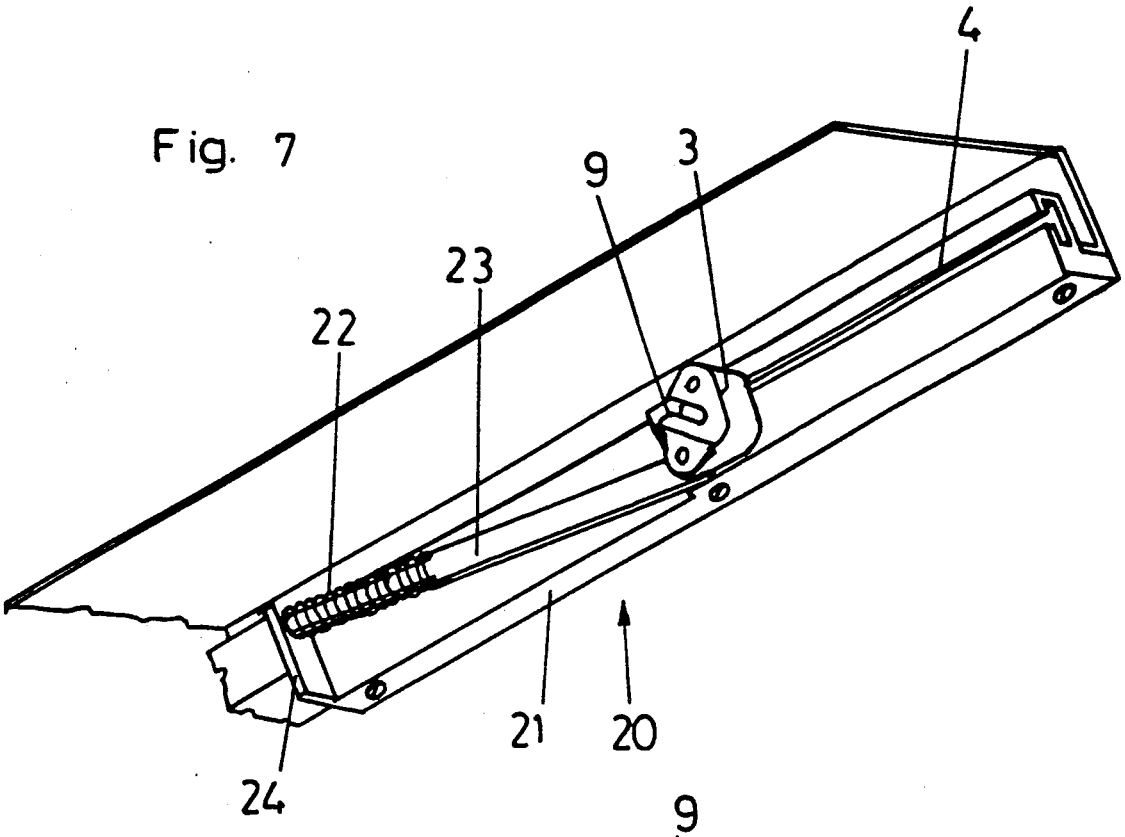
FIG. 7 is a perspective view of a closing device according to a further embodiment of the present invention.
Figure 8:
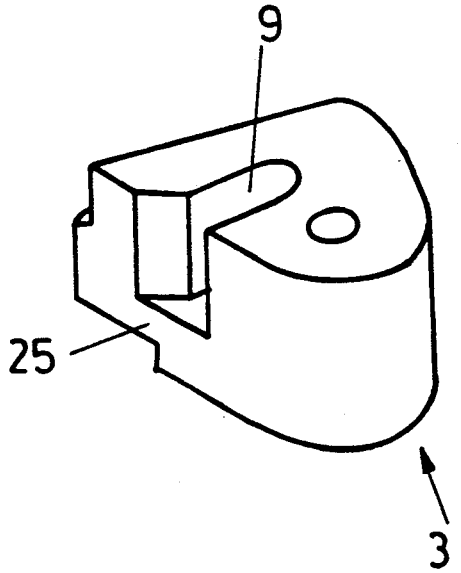
FIG. 8 is a perspective view of a tiltable member of the embodiment of FIG. 7.
Figure 12:
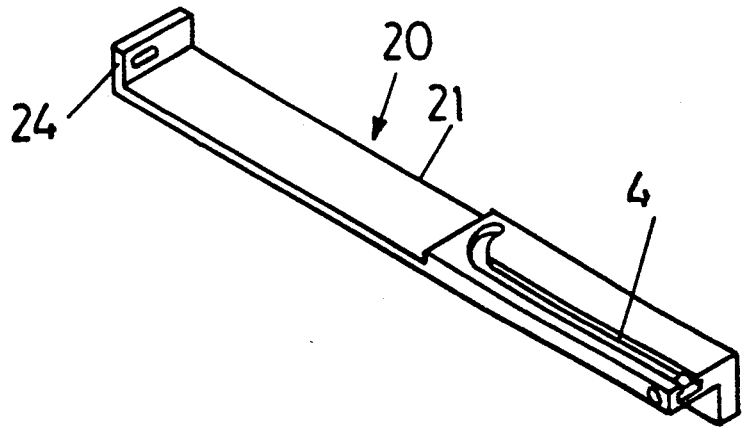
FIG. 12 is a perspective view of a block or housing member of the closing device of FIG. 7.

FIGS. 5 and 6 illustrate a further embodiment of the present invention that is similar to the embodiment of FIGS. 1-4. In the embodiment of FIGS. 5 and 6, the tiltable member 3 is mounted within a rail 17 that is attached to a supporting rail 16 that is fastened to the furniture body side wall 2. Tiltable member 3 has a U-shaped configuration including a pair of spaced flanges 3'. Guide rods 8 extend upwardly and downwardly from respective flanges 3' into slots 4 defining guide tracks in upper and lower flanges of rail 17. Each slot 4 has a rectilinear rear portion and an arcuate forward portion, in a manner similar to that of the embodiment of FIGS. 1–4. Tiltable member 3 projects through a rectilinear slot 18 in rail 17 and has therein a slot similar to slot 9 of the embodiment of FIGS. 1–4. Pin member 5 is mounted on a pull-out rail 13 attached to drawer side wall 1 beneath a drawer bottom 12. Pull-out rail 13 is supported on a flange 15 of supporting rail 16 for relative sliding movement by means of rollers 14. Rollers 14 may be mounted directly on rails 13, 15 or may be mounted in a carriage. Spring 6 is positioned between the flanges 3' and has a first end connected to rail 17 and a second end connected to tiltable member 3. The embodiment of the closing device of FIGS. 5 and 6 operates in the same manner discussed above as the embodiment of FIGS. 1–4.

Figure 9:
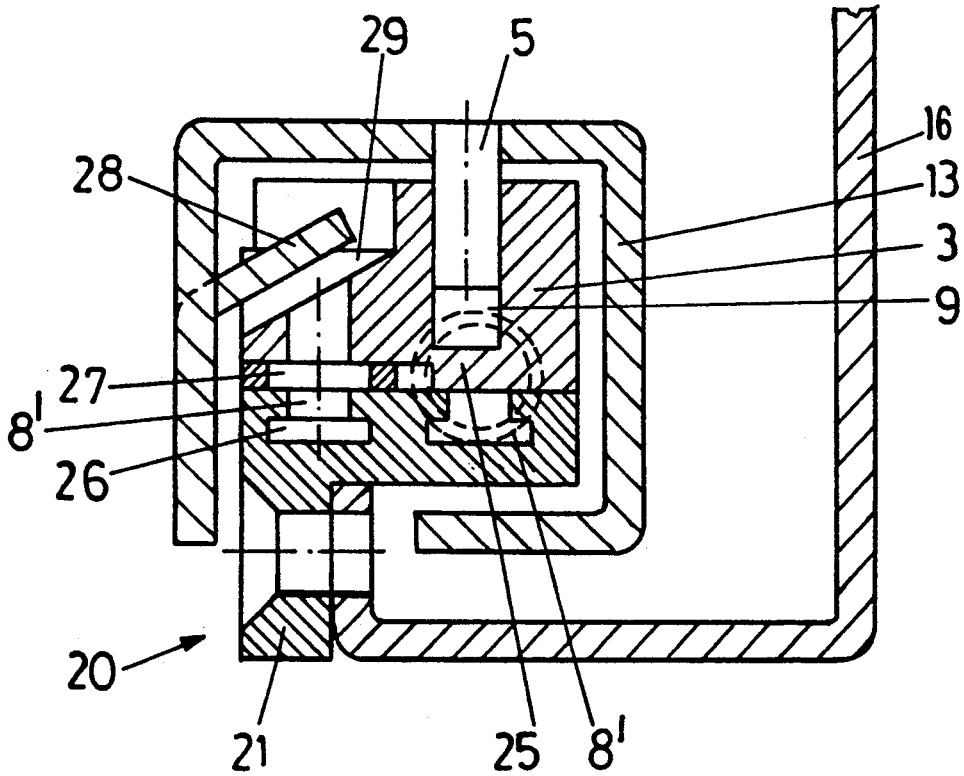
FIG. 9 is a cross-sectional view of the elements of the embodiment of FIG. 7.
Figure 10:
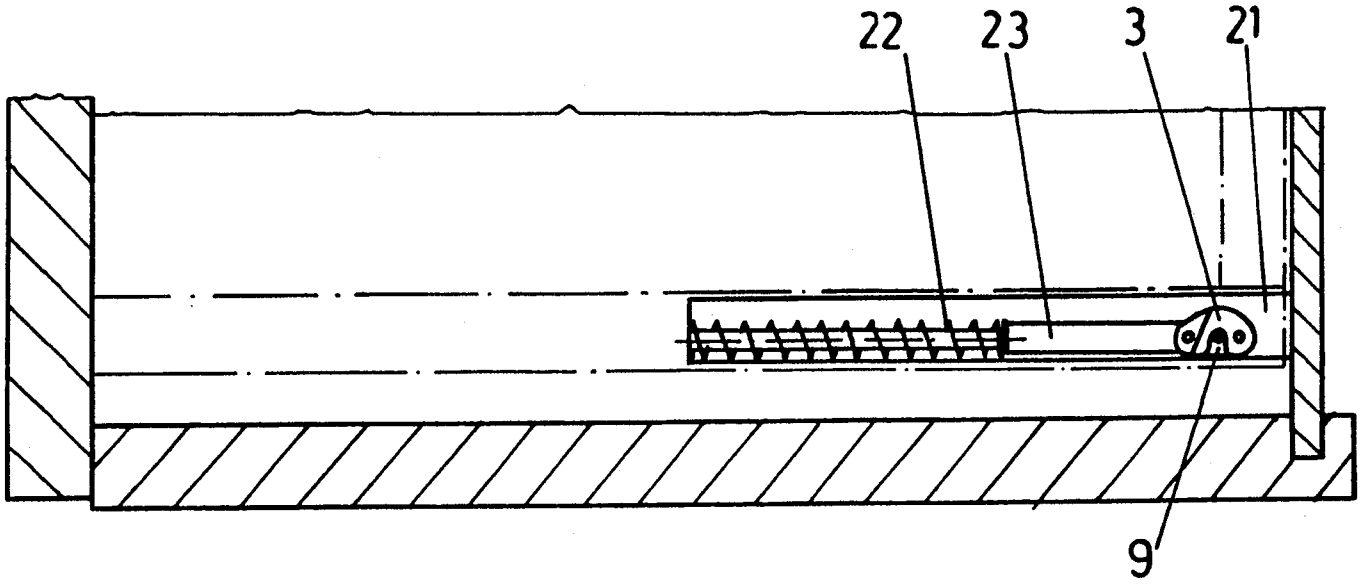
FIG. 10 is a top view of the closing device of FIG. 7 mounted on an article of furniture and shown in a closed position of a drawer.
Figure 11:
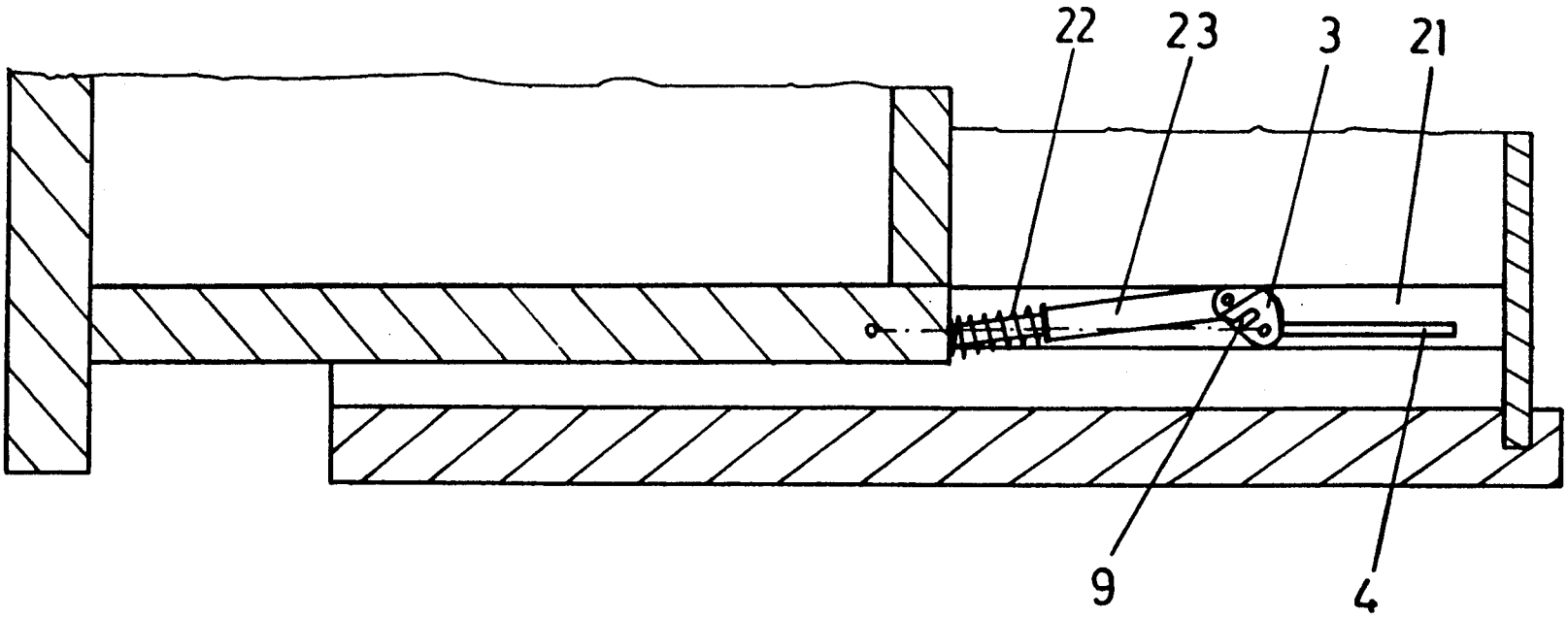
FIG. 11 is a view similar to FIG. 10 but illustrating the closing device in an open position of the drawer.

FIGS. 7–12 illustrate a further embodiment of the present invention. As shown in FIG. 9, a supporting rail 16 attached to a furniture body side wall has mounted thereon, for example by screws, a block 21, for example formed of plastic. Pin member 5 extends from a pull-out rail 13 mounted on the drawer. Tiltable member 3 has a catch notch or slot 9 into which fits pin member 5. Tiltable member 3 has extending therefrom guide rods 8' that extend into a guide track 4 formed in block 21. In this embodiment the groove that defines the guide track 4 is T-shaped, and guide rods 8' have a complementary shape including heads 26 to the retain guide rods in the guide track. Each guide rod also has an annular flange 27 to retain the guide rod on the block 21. As particularly is apparent from FIG. 9, the pin member 5 and guide rods 8' are aligned vertically. As a result, tiltable member 3 tilts about a vertical axis in a horizontal plane. Also, pull-out rail 13 has extending therefrom a stop 28 to abut with a counterstop 29 on tiltable member 3. This embodiment of the present invention operates essentially in the same manner as the previous embodiments. However, spring 22 in this embodiment is compressed by the movement of the tiltable member 3 forwardly along the guide track 4 relative to the furniture body, i.e. with outward movement of the drawer. Therefore, spring 22 is compressed when the tiltable member moves in a forward first direction relative to the furniture body, and spring 22 expands to move the tiltable member 3 in a rearward second direction relative to the furniture body. Furthermore, in this embodiment the closing device is formed as a unit or a unitary kit 20 that is mounted on the supporting rail 16. Thus, the kit 20 includes block 21 defining guide track 4 and to which is mounted the tiltable member 3. Spring 22 is mounted on a slide rod 23 and abuts against a base portion 24 of block 21. The provision of the unitary kit 20 being mountable on rail 16 provides a very compact structure that also enables the pull-out guide assembly to be compact. It is possible to position such closing device beneath a drawer bottom, thereby saving space. The closing device essentially is a part of the pull-out guide assembly, and thereby mounting is facilitated.

Figure 16:
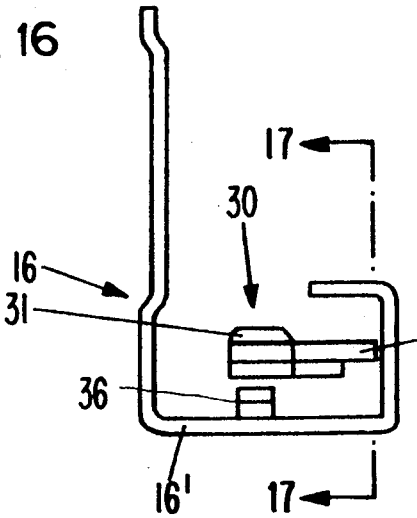
FIG. 16 is a view similar to FIG. 15, but exploded to illustrate the closing device not yet mounted on the supporting rail.
Figure 17:
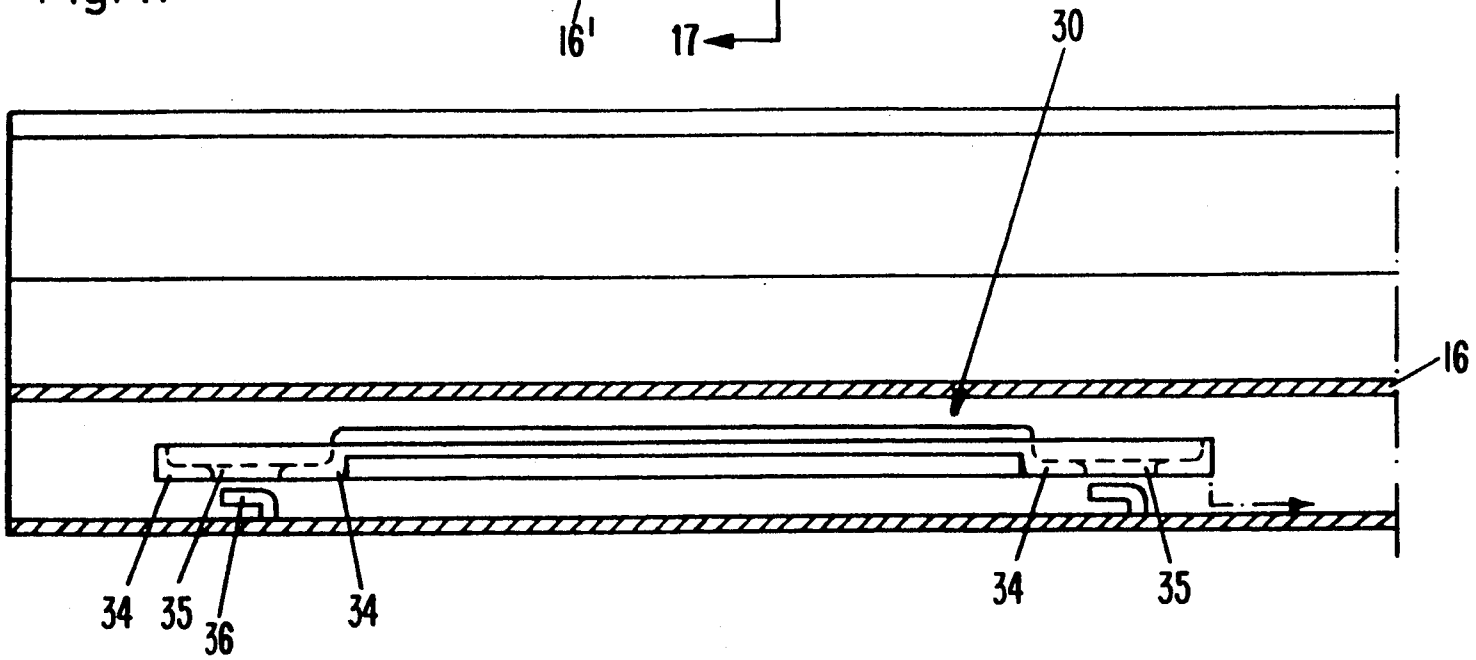
FIG. 17 is a sectional view taken along line 17—17 of FIG. 16.
Figure 18:
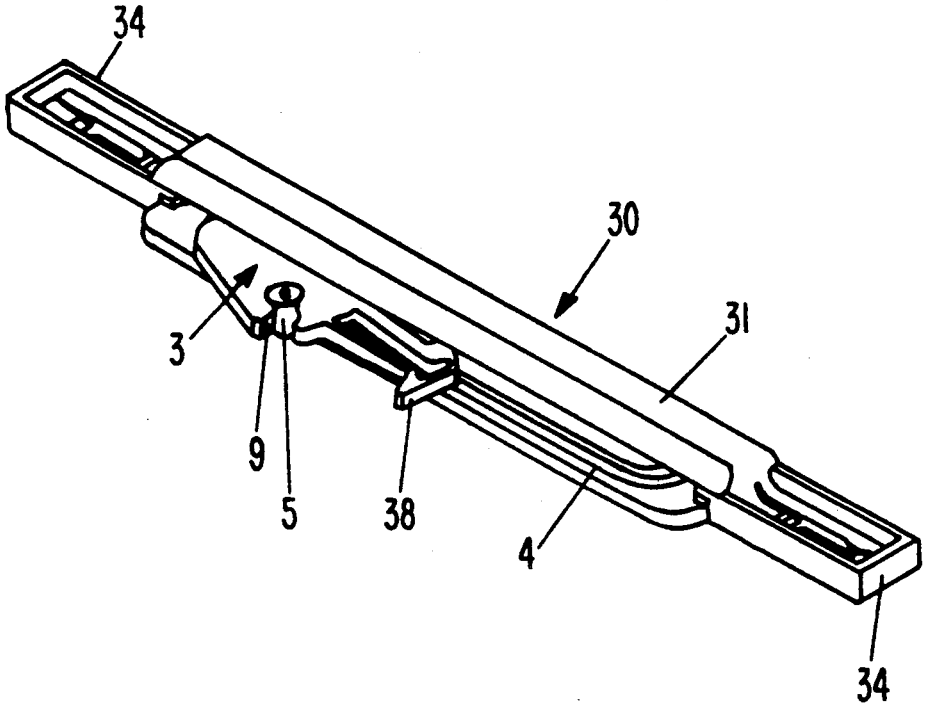
FIG. 18 is a perspective view of the closing device of this embodiment.
Figure 19:
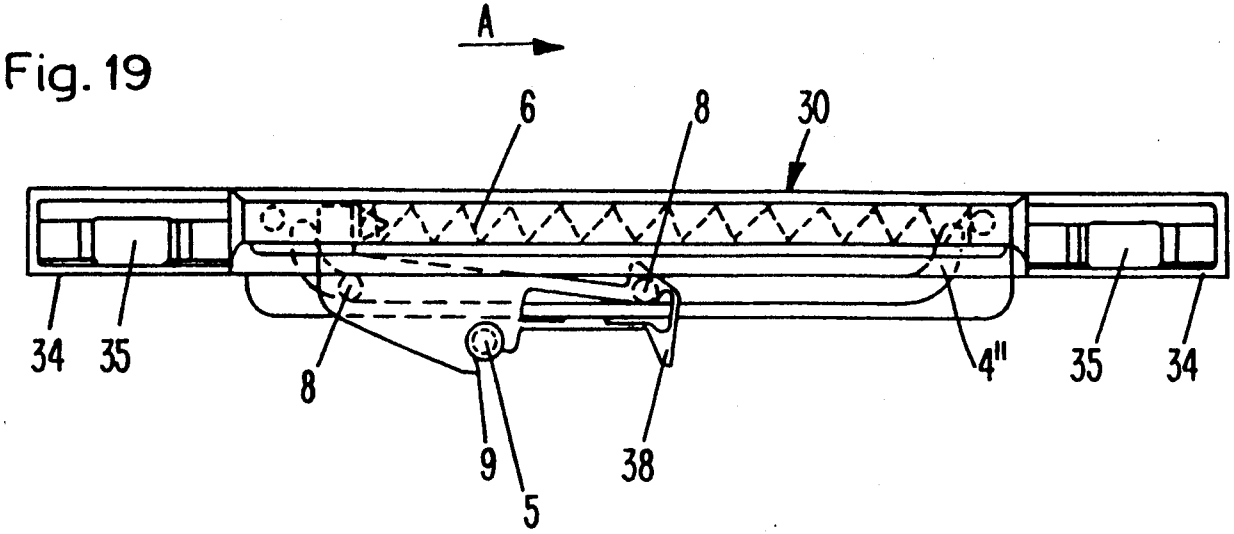
FIG. 19 is a plan view of this embodiment of the closing device with the elements thereof being shown in a position whereat the drawer would be closed.
Figure 20:
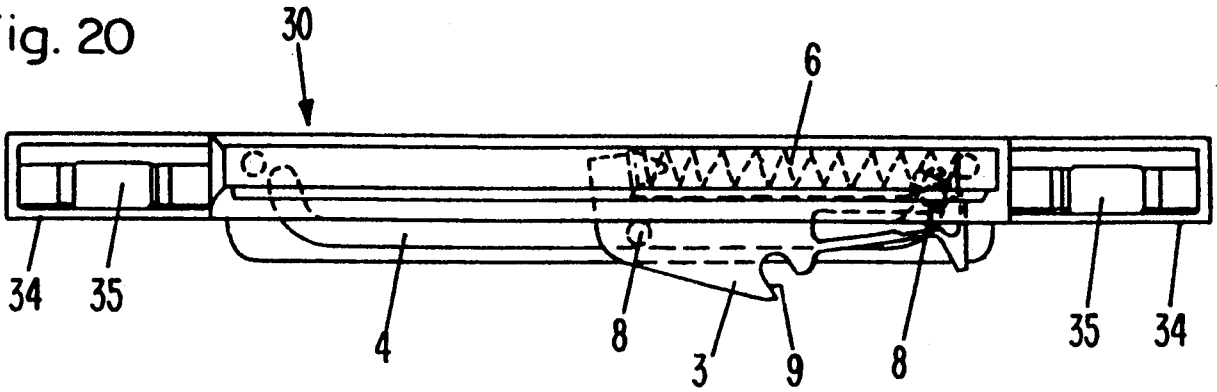
FIG. 20 is a view similar to FIG. 19, but illustrating the elements in an open position of the drawer.
Figure 21:
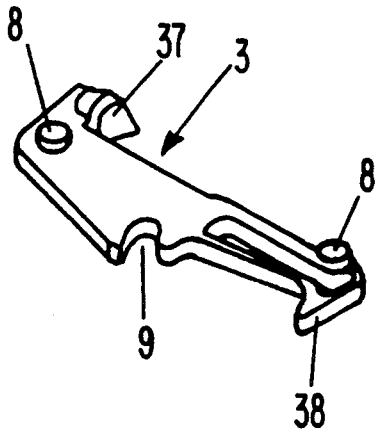
FIGS. 21-23 are perspective views illustrating various elements of this embodiment of the closing device.
Figure 22:
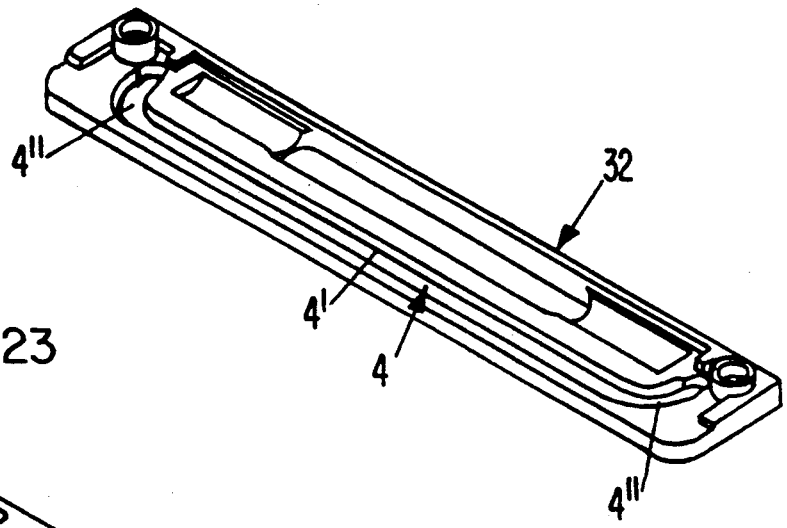
Figure 23:
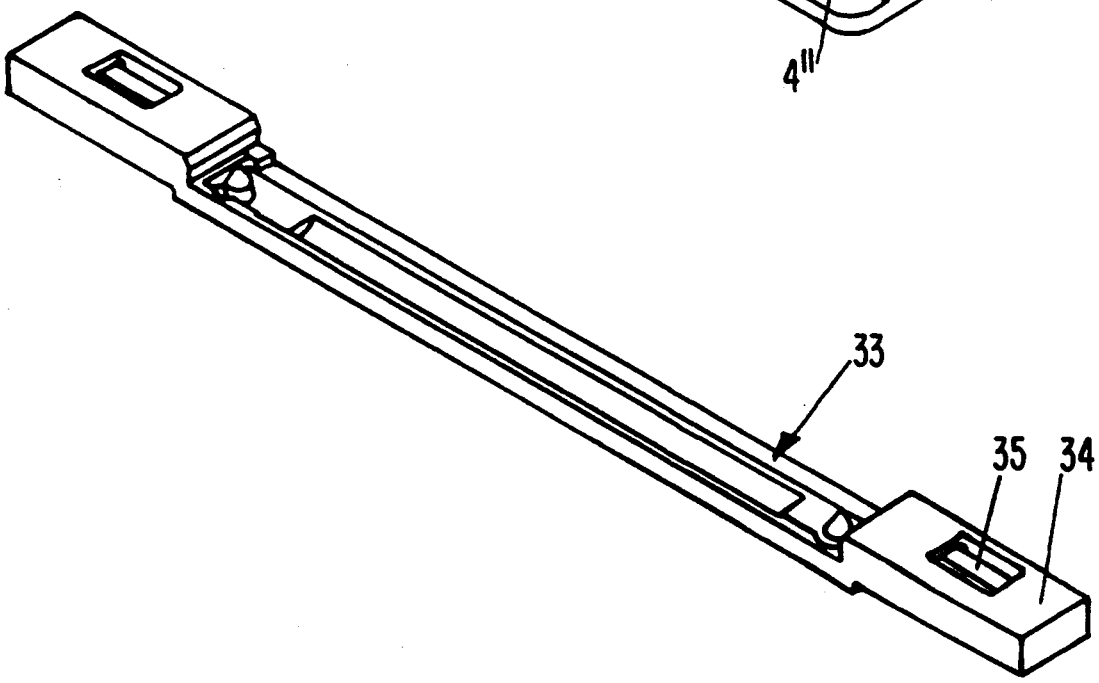

With reference now to FIGS. 13–24, a further embodiment of the present invention will be described. In this embodiment, as particularly shown in FIG. 15, pin member 5 projects downwardly from a pull-out rail 13 connected to a side of a drawer. The remaining elements of a closing device 30 are in the form of a unit or unitary kit mounted on a supporting rail 16 fastened to the furniture body. It is possible that the elements can be connected to the drawer and furniture body themselves, but a preferred arrangement is as illustrated, i.e. with the respective elements are connected to the rails. FIG. 18 shows the closing device assembled, and FIGS. 21–23 illustrate the elements forming the unit or unitary kit of the closing device, other than pin member 5. These elements include a housing 31 formed by two housing elements 32, 33 that are fastened together with tiltable member 3 therebetween. Housing element 32 defines therein a guide track in the form of a groove 4 having a rectilinear portion 4' that has at each of opposite ends thereof respective arcuate portions 4''. By this arrangement, it is possible to use closing devices of identical construction on opposite sides of the drawer. Housing elements 32 and 33 as well as tiltable member 3 advantageously are formed of injection molded plastic material in any conventional advantageous manner and are assembled simply. Housing element 33 has at opposite ends thereof support portions 34 having therein holes or openings 35. Extending upwardly from a lower flange 16' of supporting rail 16 are tabs 36 that fit through openings 35 in housing element 33, thereby retaining such element, and thereby also housing element 32 and tiltable member 3, in position on the supporting rail. For example, tabs 36 may be punched from the material, for example, metal, of rail 16 and bent upwardly and outwardly as shown in FIGS. 16 and 17. Housing elements 32 and 33 are assembled together, for example by bolts, with tiltable member 3 therebetween and with guide rods 8 of tiltable member 3 extending into groove 4. Spring 6 is mounted in this assembly, with one end thereof fitting on or attached to a spring guide 37 on tiltable member 3 and an opposite end braced against housing 31, and particularly an edge of housing element 33. In this embodiment spring 6 is a helical spring that is compressed upon movement of tiltable member 3 in the first direction, i.e. in direction A shown in FIG. 19 and to be discussed in more detail below. However, it is contemplated that the housing 31 could be of a construction to enable spring 6 to be a helical spring that is stretched upon movement of the tiltable member in the first direction and thereby that contracts to impart the urging force to return the tiltable member in the second direction. A housing having such a construction is illustrated in FIG. 25 wherein a housing 31' defines therein a guide track in the form of a groove including rectilinear portion 4' and only a single arcuate portion 4''. This housing 31' is adapted to be mounted on a rail 16 in the same manner as housing 31 discussed previously. In this case, a pin 37' of the housing mounts a first end of spring 6, and the opposite end of the spring would be attached to the tiltable member 3. Thus, as the tiltable member 3 moves along the groove toward the arcuate portion 4'', the spring would be stretched or expanded. This would cause the spring to contract during its application of an urging force returning the tiltable member away from the arcuate portion of the guide track groove.

The device of the embodiment of FIGS. 13–24 operates in a manner as illustrated in FIGS. 19 and 20. Thus, with the drawer in a closed position within the furniture body, pin member 5 extending from pull-out rail 13 is positioned within catch slot or groove 9 of tiltable member 3. As the drawer is pulled in direction A outwardly of the furniture body, pin member 5 pulls tiltable member 3 along groove 4. When the predetermined position, i.e. arcuate portion 4", is reached, the tiltable member 3 tilts in a first pivot direction to the position shown in FIG. 20. This pivoting is about an axis defined by the leftmost guide rod 8 shown in FIG. 20. Thereafter it is possible for pin member 5 to withdraw from groove 9 so that the drawer then is freely movable inwardly and outwardly of the furniture body. At such time, the tiltable member 3 is in a locked position preventing compressed spring 6 from returning the tiltable member 3 in a second direction opposite to first direction A. However, when the drawer is moved inwardly of the furniture body to such an extent that pin member 5 again enters groove 9, thereafter the pin member 5 pushes the tiltable member 3 in the second direction out of arcuate portion 4" The spring member 6 then acts to return tiltable member 3, pin member 5 and the drawer to the fully inserted position within the furniture body. As illustrated in FIGS. 19 and 20, it is the rightmost arcuate portion 4" that is operative. However, if the same assembly were employed on the opposite side of the drawer, then the assembly would be turned by 180° and it would be the opposite arcuate portion that would be operative.

This embodiment of the present invention also illustrates an additional feature of the present invention. Thus, tiltable member 3 is provided with a bendable catch 38 that can be employed to reposition the closing device when the closing device unintentionally moves into rectilinear portion 4' when the drawer is open. In other words, it is possible that the tiltable member might be in its rearmost position when the drawer is not entirely pushed into the fully inserted position within the furniture body. In such case, the pin member 5 would not easily be insertable into groove 9. Normally it would be necessary to manually employ a tool such as a screwdriver to move the tiltable member to its forward position so that the pin member could be reinserted into slot 9. However, by the provision of bendable catch 38, such manual operation is not necessary. Rather, if the tiltable member 3 is in the position of FIG. 19, but with pin member 5 not being in slot 9, it is possible to properly reposition the elements. Thus, by pushing the drawer inwardly pin member 5 will move past bendable catch 38, due to the bendable nature thereof. Thereafter when the drawer is moved further outwardly, the pin member will catch on the rear surface of bendable catch 38. This will pull the tiltable member 3 outwardly in the direction A against the force of spring 6 until the tiltable member 3 is in the locked position shown in FIG. 20. Thereafter, when the drawer is moved inwardly the pin member 5 will be reinserted into slot 9 in the normal manner, and thereafter operation will be as described above.

Figure 13:
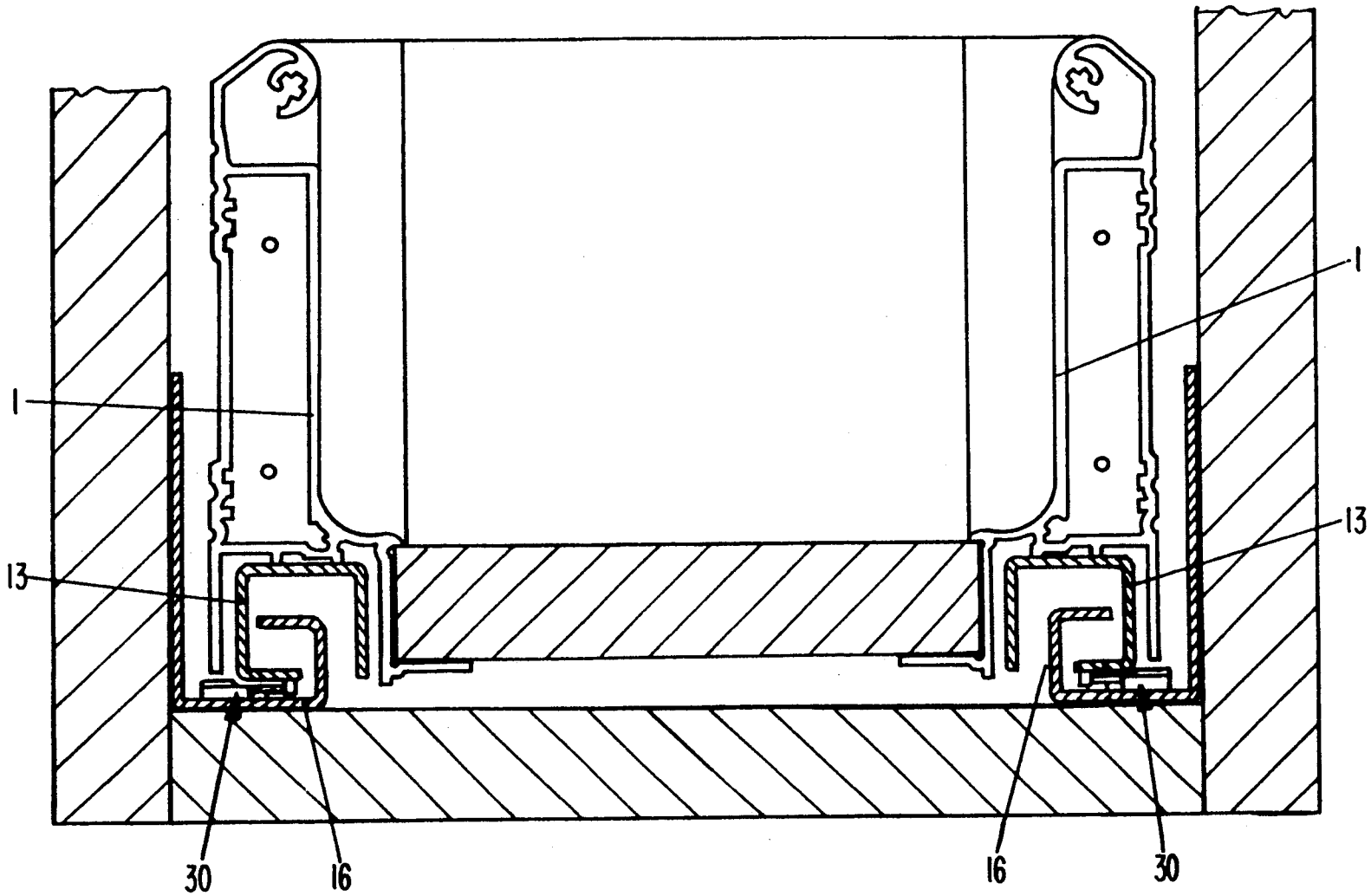
FIG. 13 is a sectional view illustrating an article of furniture incorporating, on opposite sides of a drawer, closing devices according to another embodiment of the present invention.
Figure 14:
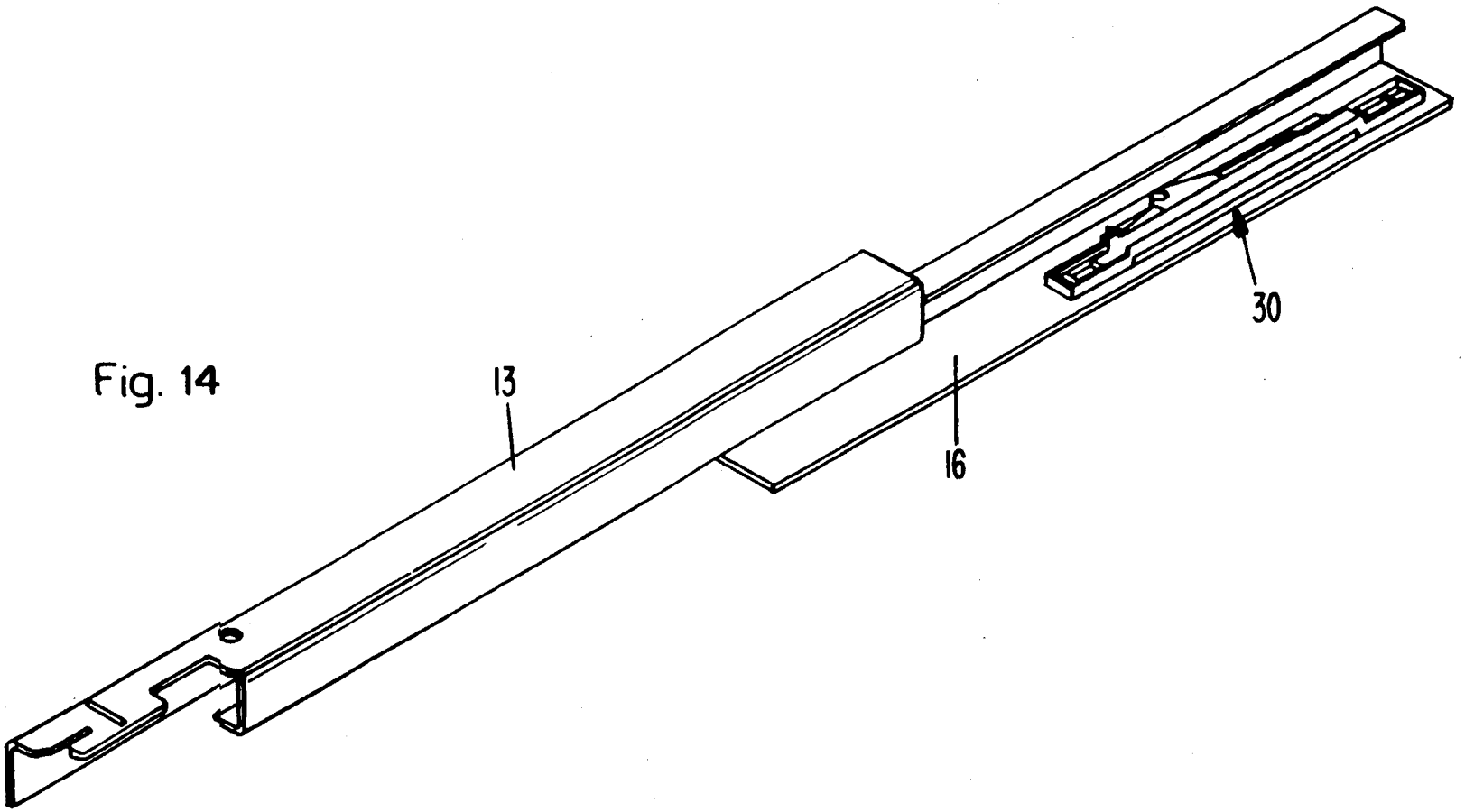
FIG. 14 is a perspective view of supporting and pull-out rails incorporating this embodiment of the closing device according to the invention.
Figure 15:
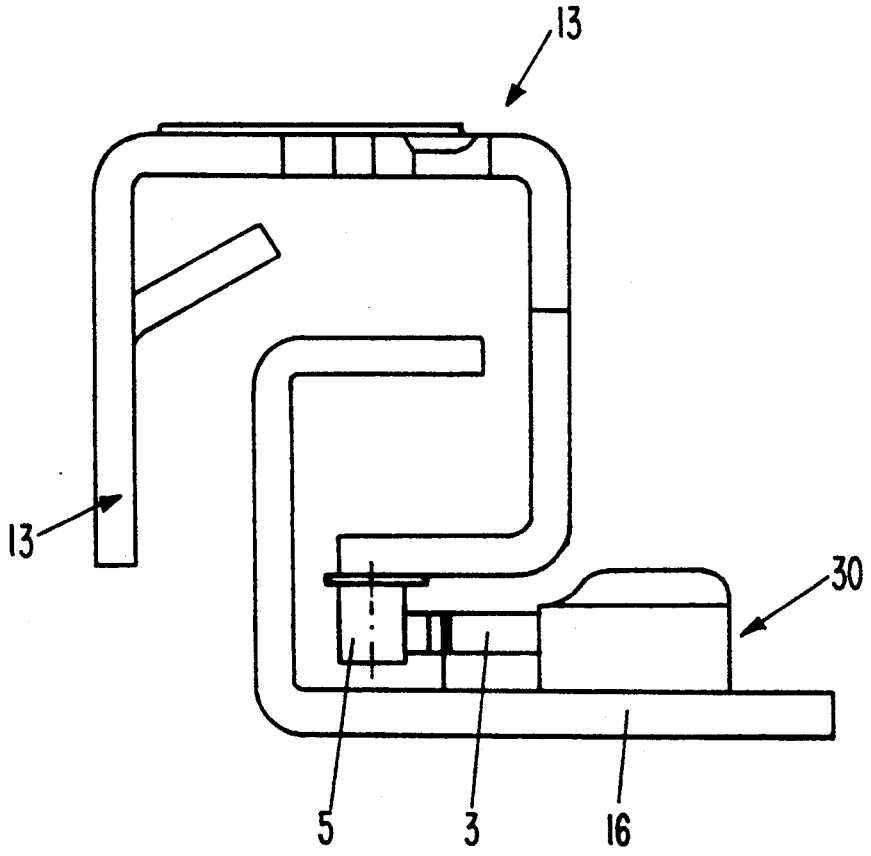
FIG. 15 is a front view of the rails and such closing device.

As mentioned above, the housing 31 is symmetrical and therefore can be used on both sides of the drawer. Furthermore, as illustrated in FIG. 13, the article of furniture may be provided with closing devices 30 on both sides of the drawer. It of course would be possible to achieve closing of the drawer by use of a closing device on only one side of the drawer. However, by employing closing devices on both sides of the drawer, it is possible to achieve an additional desired result in accordance with the present invention. Thus, it is possible to arrange the two closing devices 30 on the opposite sides of the drawer in an offset or staggered relationship with respect to each other in the direction of movement of the drawer. In other words, one of the closing devices may be mounted relatively forwardly with respect to the article of furniture, and the closing device on the opposite side of the drawer may be located more rearwardly. By this arrangement it is possible to increase the overall distance through which the drawer is pulled into the furniture body. It is possible to prevent too large a force from acting at the start of the pulling motion and also to prevent the pull-in motion from being jerky.

Figure 24:
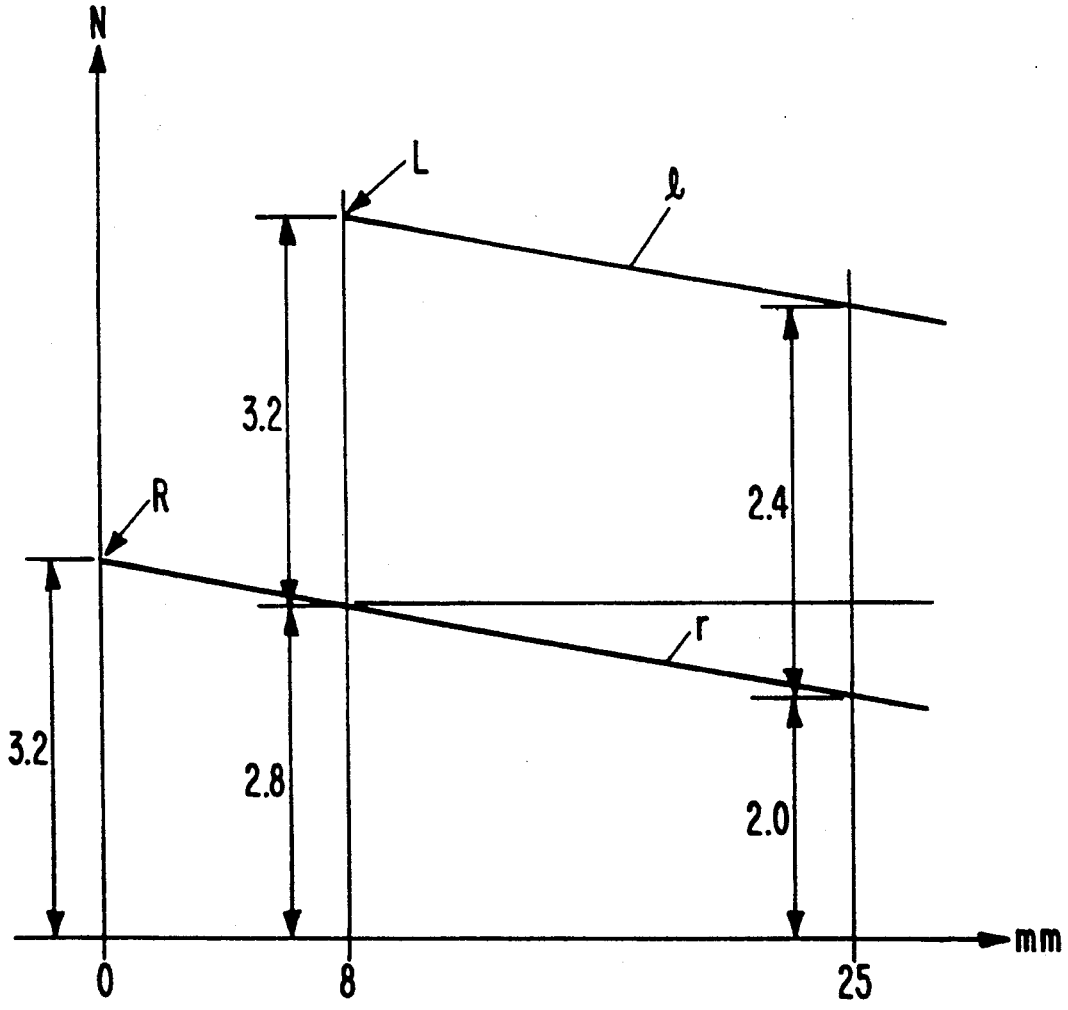
FIG. 24 is a graph illustrating force-distance relationships of a pair of closing devices of this embodiment employed on opposite sides of the drawer.
Figure 25:
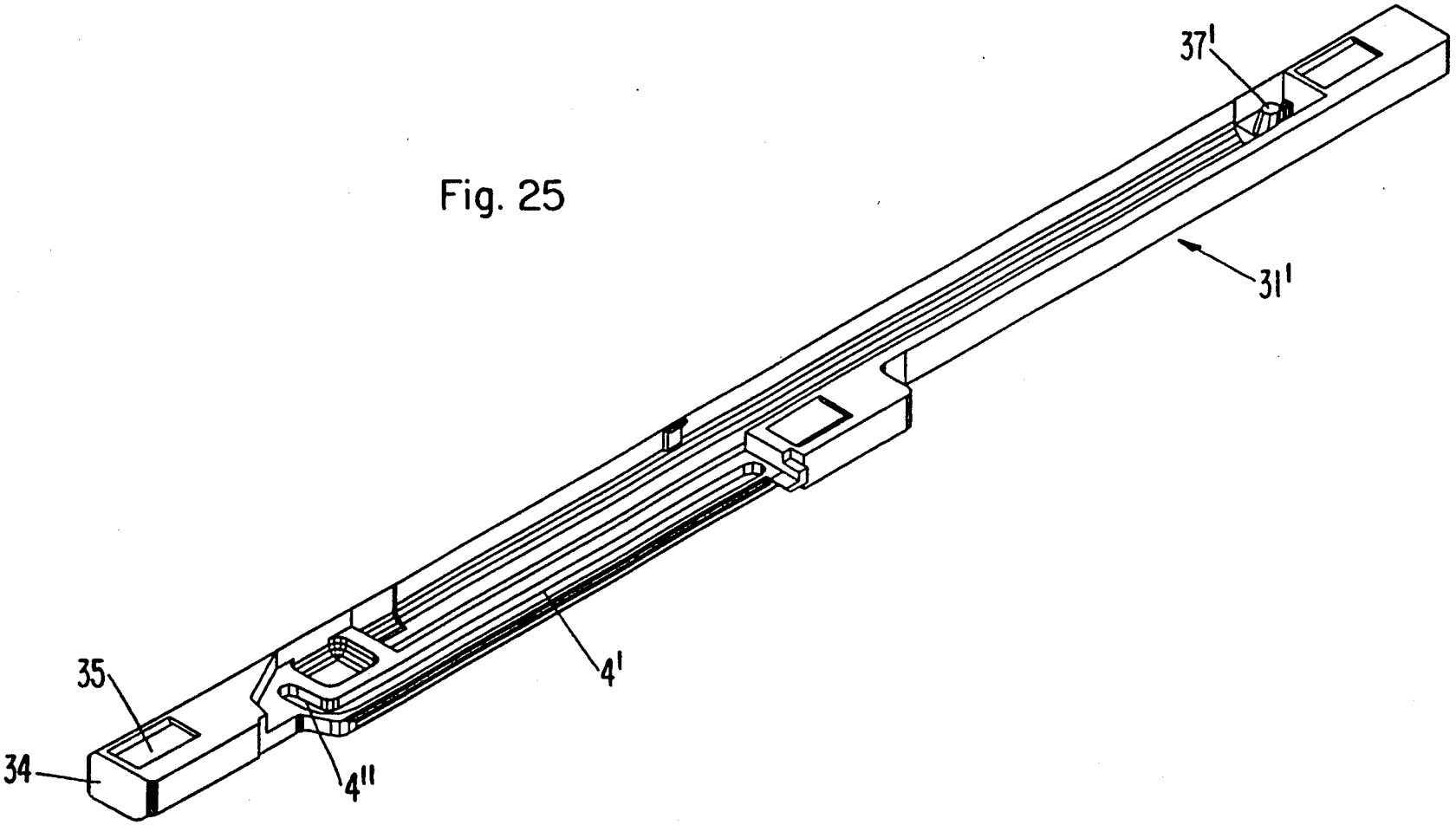
FIG. 25 is a perspective view of a housing element of a closing device that may be employed alternatively to the elements shown in FIGS. 22 and 23, and particularly for use with a different type of helical spring.

With reference now to FIG. 24, a graphic illustration of the operation of two closing devices that are longitudinally offset from each other will be described. In the arrangement represented by FIG. 24, the closing device on the right side of the drawer is located more forwardly than is the closing device on the left side of the drawer. As a result, the closing device on the right side becomes operative before operation of the closing device on the left side. The diagram of FIG. 24 represents force in newtons in the ordinate and distance the drawer is moved in millimeters on the abscissa. The point R indicates the point at which the pin member 5 of the closing device on the right side of the drawer starts to be moved inwardly of the furniture body by the tiltable member 3 thereof. Point L denotes the point at which the pin member of the closing device on the left side of the drawer starts to be pulled inwardly by the tiltable member 3 thereof. The distances and forces represented in FIG. 24 are exemplary only and not limiting of the present invention. Such quantities would be variable in a manner understood by one skilled in the art. Lines l and r represent the force-distance courses of the closing devices on the left and right sides of the drawer, respectively. It is to be understood that this offset or staggered arrangement of the closing devices could be employed in all of the various embodiments of the present invention. Furthermore, it is to be understood that this embodiment, as well as the other embodiments of the present invention, incorporate any necessary guide rollers, carriages or bearings acting between the supporting and pull-out rails as is conventional in the art.

Figure 26:
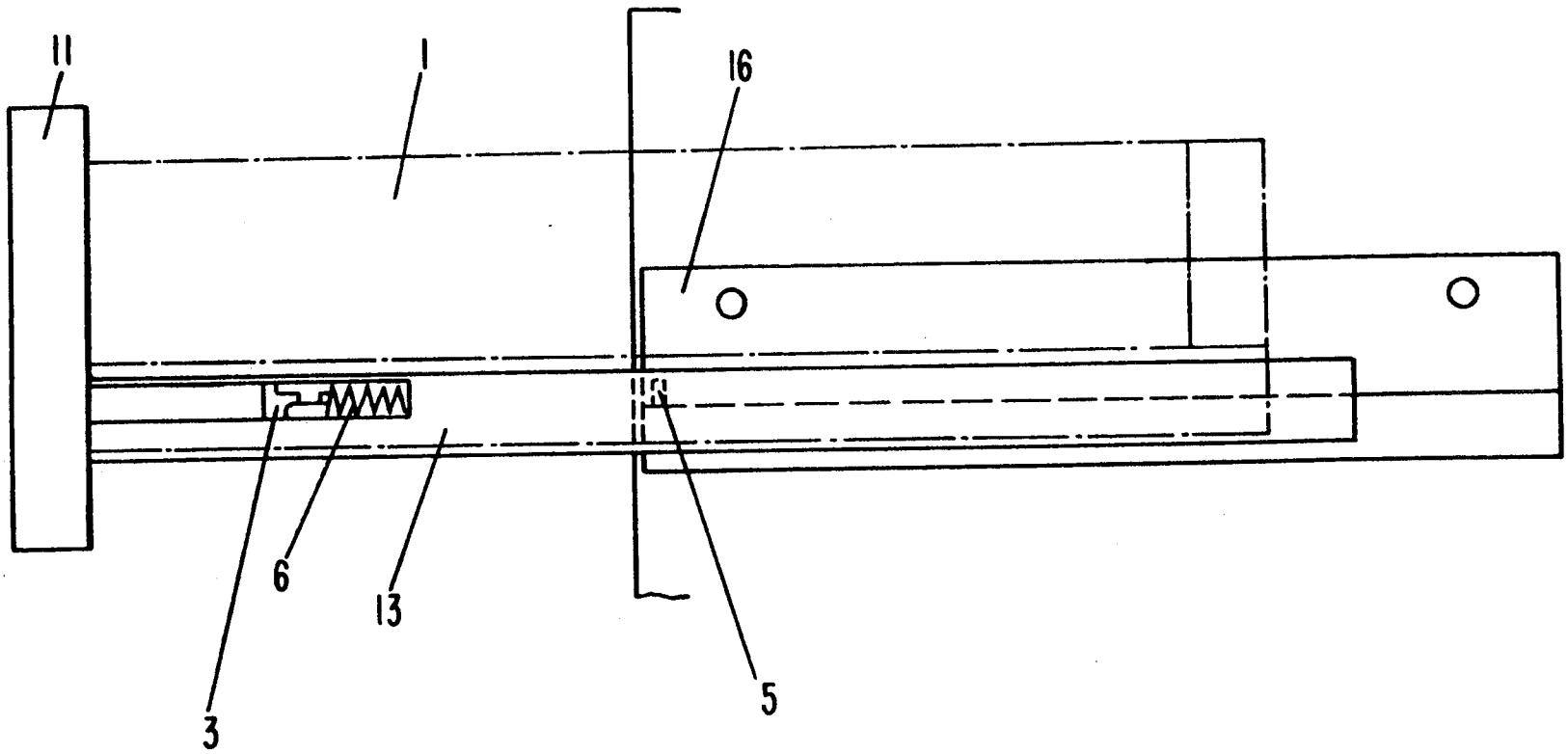
FIG. 26 is a schematic side view illustrating a closing device according to a further embodiment of the present invention, with a drawer being shown as open.
Figure 27:
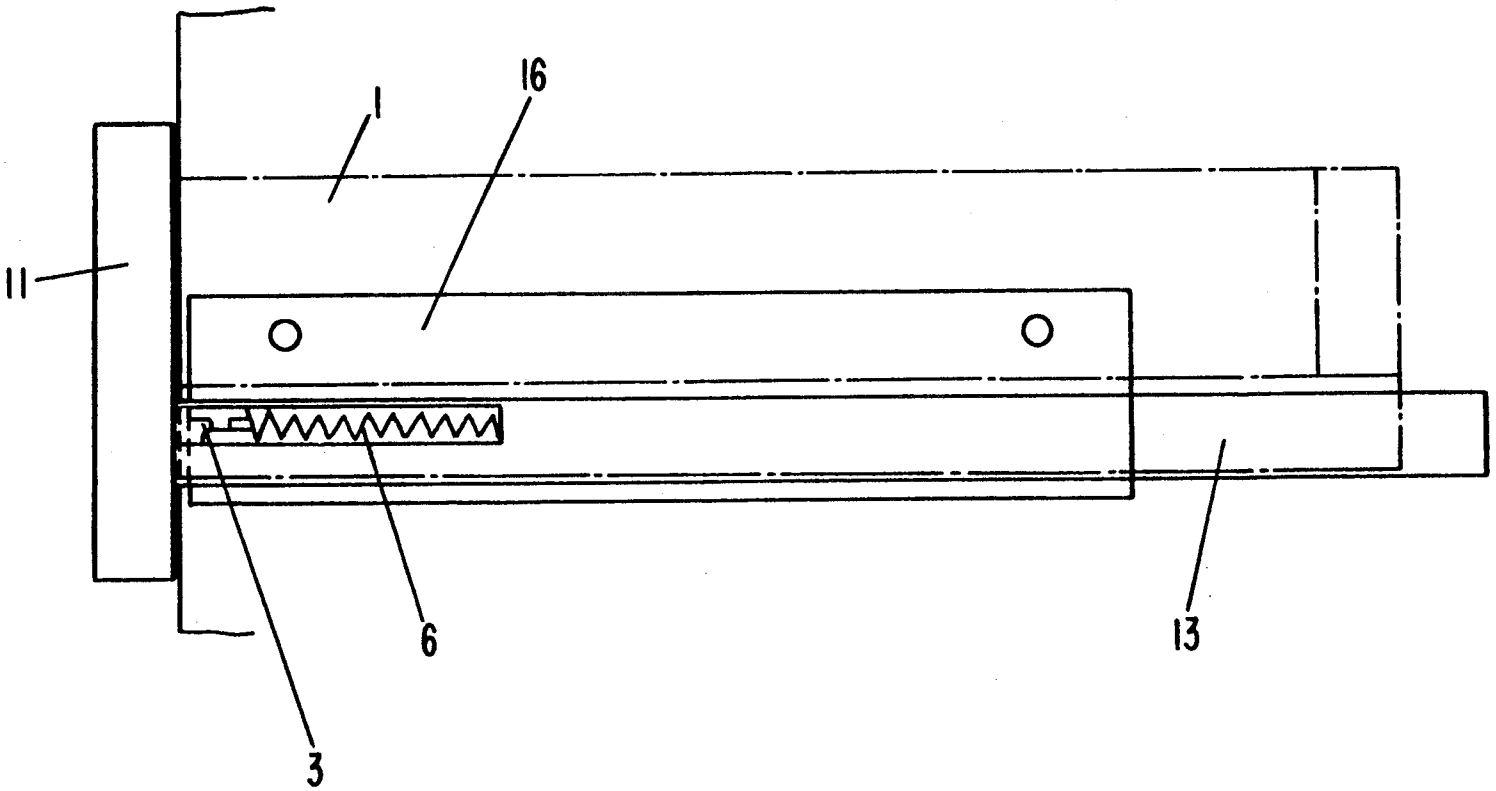
FIG. 27 is a view similar to FIG. 26 but showing the drawer closed.

In the above described embodiments of the present invention, the pin member is mounted on the drawer or on the pull-out rail, and the tiltable member is mounted on the furniture body or on the supporting rail. It is possible however in accordance with the present invention to reverse this arrangement. In other words, it is possible for the pin member 5 to be mounted on the furniture body or on the supporting rail and for the tiltable member to be mounted on the drawer or on the pull-out rail. Such arrangements are illustrated schematically in FIGS. 26 and 27 that respectively illustrate a drawer in a fully open position and in a fulled inserted position. FIGS. 28–31 and 32–34 illustrate specific embodiments encompassed within the aspect of the invention illustrated schematically in FIGS. 26 and 27.

With specific reference to FIGS. 28–31, pin member 5 is mounted on supporting rail 16 attached to the furniture body and extends upwardly. A housing 40 is fixed to pull-out rail 13, i.e. beneath an upper flange thereof. Housing 40 defines therein a guide track or path 41 within which rectilinearly slides a slide member 42. Tiltable member 3 is movable with slide member 42 relative to pull-out rail 13 and housing 40. Tiltable member 3 has extending therefrom a shaft portion 43 that fits within a recess 44 in slide member 42. Tiltable member 3 is pivotable about the axis of shaft portion 43 relative to the slide member 42. One side of housing 40 has therein an opening or recess 45 having a diverging or protruding edge or lip 46. Recess 45 is located at a position corresponding to the predetermined relative position between the tiltable member 3 and housing 40, pull-out rail 13 and the drawer. Tiltable member 3 has extending therefrom a projection 47 that extends into recess 45 to thereby lock the tiltable member relative to housing 40, in a manner to be described in more detail below. Spring 6 is mounted on guide rod 23 and has opposite ends acting on slide member 42 and housing 40.

Figure 28:
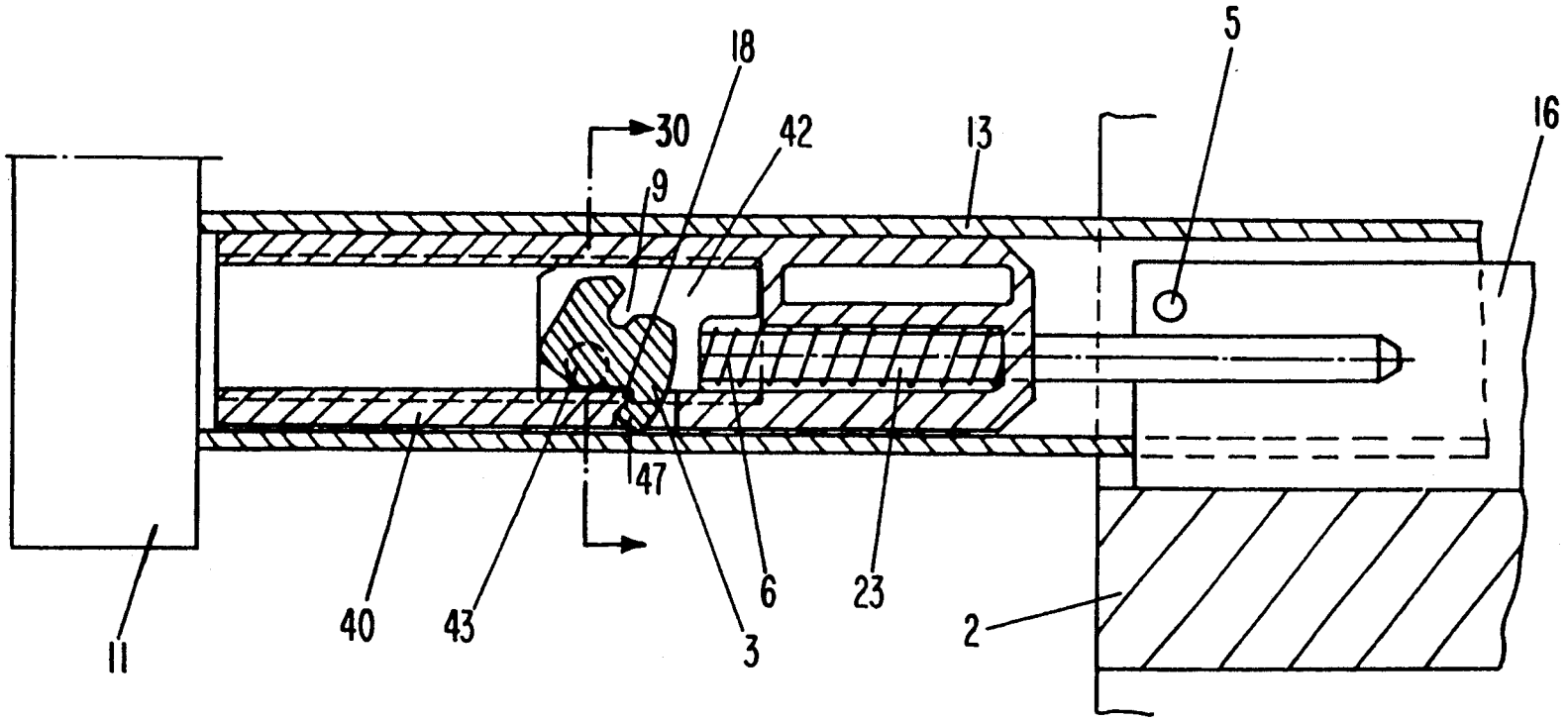
FIG. 28 is a horizontal sectional view, generally along line 28—28 of FIG. 30, illustrating the various elements of this embodiment of the present invention in positions corresponding to those shown in FIG. 26.
Figure 29:
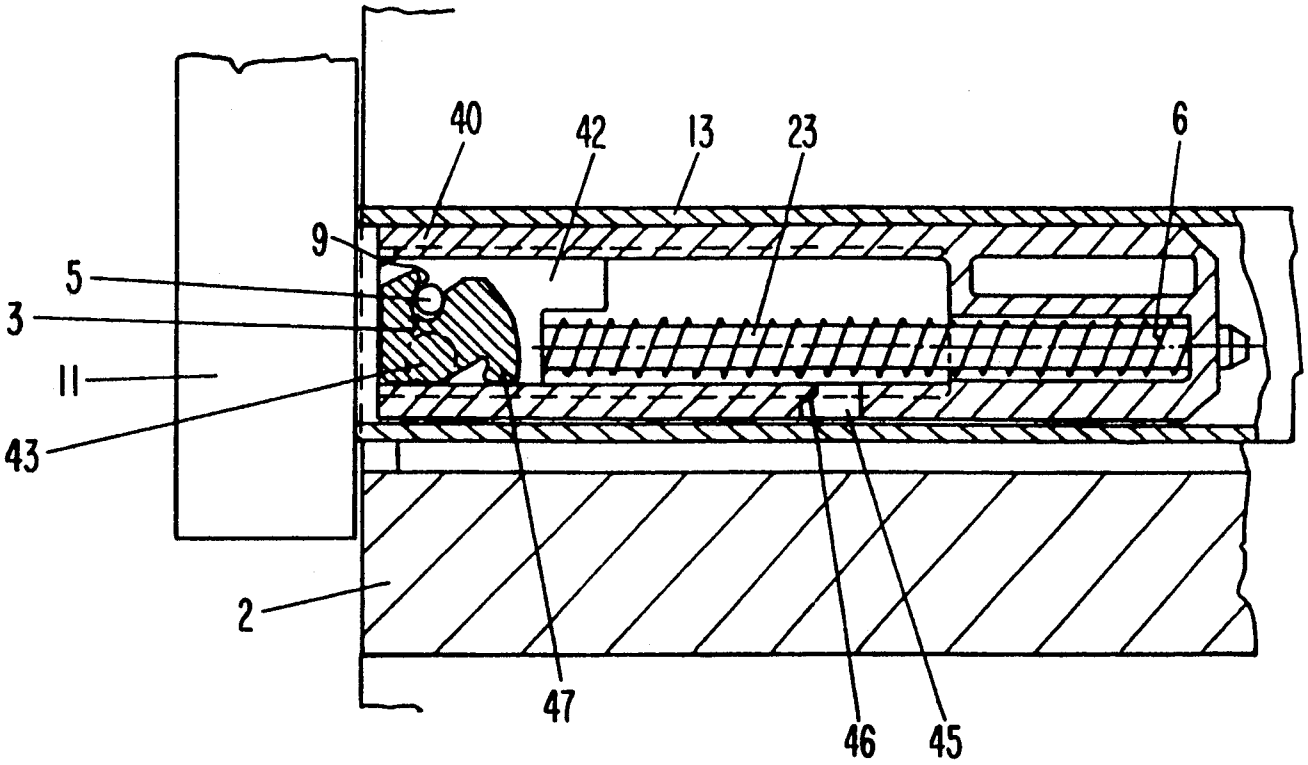
FIG. 29 a view similar to FIG. 28 but with the elements of the closing device corresponding to the position shown in FIG. 27.
Figure 30:
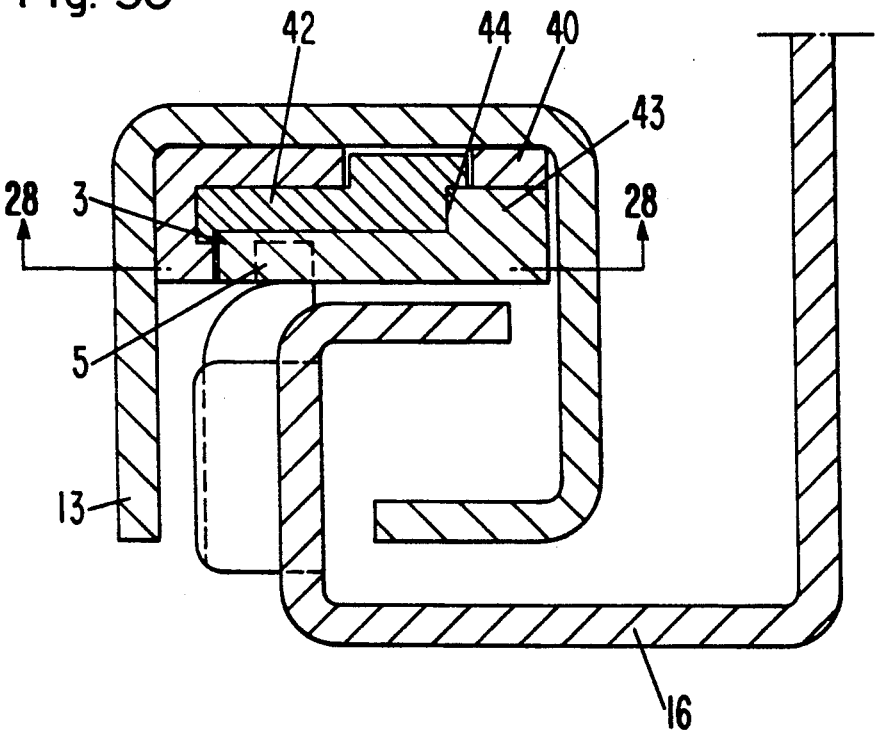
FIG. 30 a sectional view taken along line 30—30 of FIG. 28.
Figure 31:
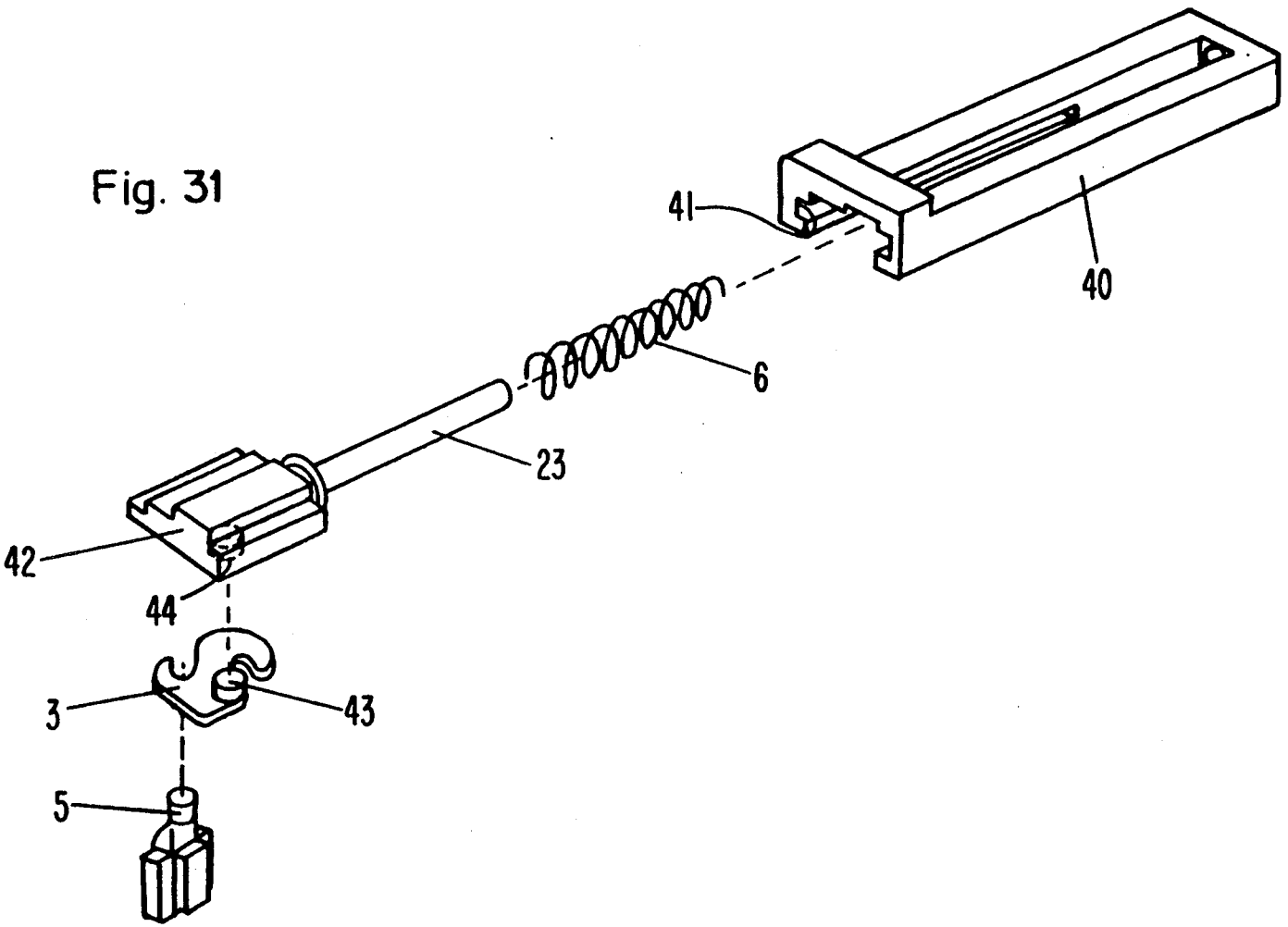
FIG. 31 is an exploded perspective view illustrating the elements of the closing device according to this embodiment.

Operation of this embodiment of the present invention now will be described in more detail with particular reference to FIGS. 28 and 29. Thus, when the drawer is in the closed position illustrated in FIG. 29, pin member 5 mounted on supporting rail 16 projects into catch slot 9 in tiltable member 3. The force of spring 6 acts between slide member 42 and housing 40. Since slide member 42 and tiltable member 3 are retained in position by pin member 5, the urging force of spring 6 acts on housing 40, particularly the right end thereof as shown in FIG. 29, to urge housing 40 inwardly of the furniture body, thereby urging pull-out rail 13 and the drawer inwardly of the furniture body also. When the drawer is pulled outwardly of the furniture body, since pin member 5 extends into slot 9 of tiltable member 3, tiltable member 3 is maintained i the position shown in FIG. 29. However, the drawer, the pull-out rail 13 and the housing 40 are moved outwardly of the furniture body. This causes deformation, i.e. compression in the example illustrated, of spring 6. This compression continues until the housing 40 is moved outwardly relative to tiltable member 3 to the position shown in FIG. 28, i.e. the predetermined relative position. At this time, the urging force of spring 6 is acting on slide member 42 in a direction to the left as viewed in FIG. 29. Slide member 42 acts in the outward direction on the tiltable member 3 by the rearward surface of recess 44. At the same time, the trailing surface of pin member 5 acts on the trailing surface of tiltable member 3 defining slot 9. In view of the fact that these two surfaces are offset, a tilting moment about the axis of shaft portion 43 is imparted to tiltable member 3, i.e. in the clockwise direction as shown in FIG. 29. As a result, when the housing 40 reaches the position shown in FIG. 28, tiltable member 3 will be instantaneously tilted in a clockwise direction such that projection 47 snaps into recess 45. As a result, tiltable member 3 is locked with respect to housing 40, and thereby with respect to the pull-out rail and the drawer. Furthermore, this tilting movement allows pin member 5 to withdraw from slot 9 so that thereafter the drawer is freely movable into and out of the furniture body, as long as the drawer is not moved inwardly to such an extent that pin member 5 again enters slot 9. When this occurs, i.e. when pin member 5 enters slot 9, further movement inwardly will cause pin member 5 to tilt tiltable member 3 about the axis of shaft portion 43 so that projection 47 is withdrawn from recess 45. At this time, the tiltable member 3 no longer is locked in position relative to housing 40. As a result, the force of spring 6 will be released. More particularly, at such time the tiltable member 3 is retained in the relative position shown in FIG. 29 by pin member 5. Therefore, the urging force of spring 6 acting between slide member 42 and housing 40 will urge housing 40 to the right as shown in FIGS. 28 and 29. Spring 6 therefore will move housing 40, pull-out rail 13 and the drawer to the fully inserted position within the furniture body.

In the above embodiment, the tiltable member 3 is tiltable in a horizontal direction about a vertical axis. However, in the embodiment of FIGS. 32–34, the tiltable member 3 is tiltable vertically about a horizontal axis 53. Thus, fixedly attached to pull-out rail 13 is a housing 50. Relatively longitudinally slidable within housing 50 is a slide member 52. Tiltable member 3 is pivoted with respect to slide member 52 about horizontal axis 53. Tiltable member 3 has extending upwardly therefrom a projection 57 adaptable to extend through a recess or opening 55 in housing 50 and also through the pull-out rail. Opening 55 has an edge 53 against which abuts projection 57. Pin member 5 is mounted on and extends upwardly from supporting rail 16.

Figure 32:
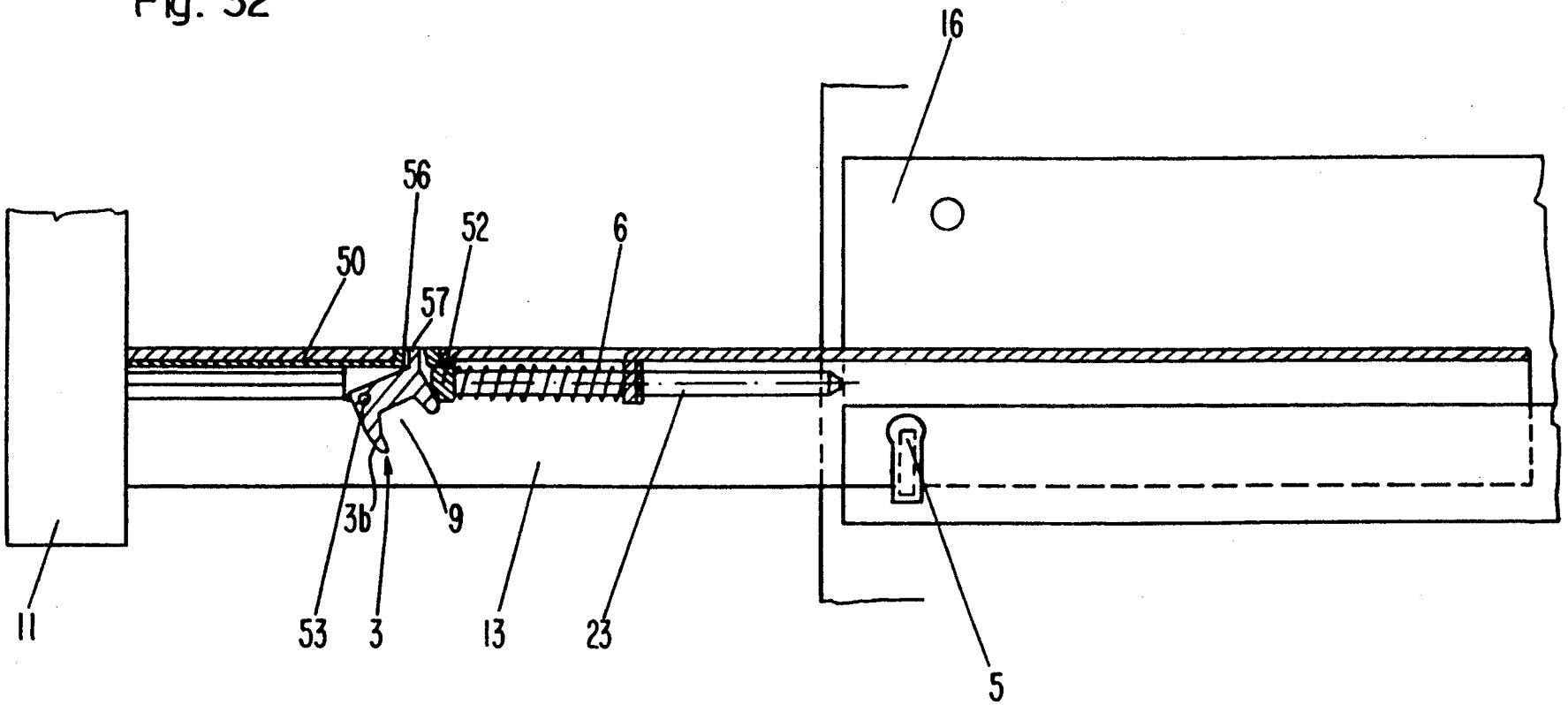
FIG. 32 is a vertical sectional view of another embodiment of the present invention and illustrating elements thereof in the open position of the drawer shown in FIG. 26.
Figure 33:
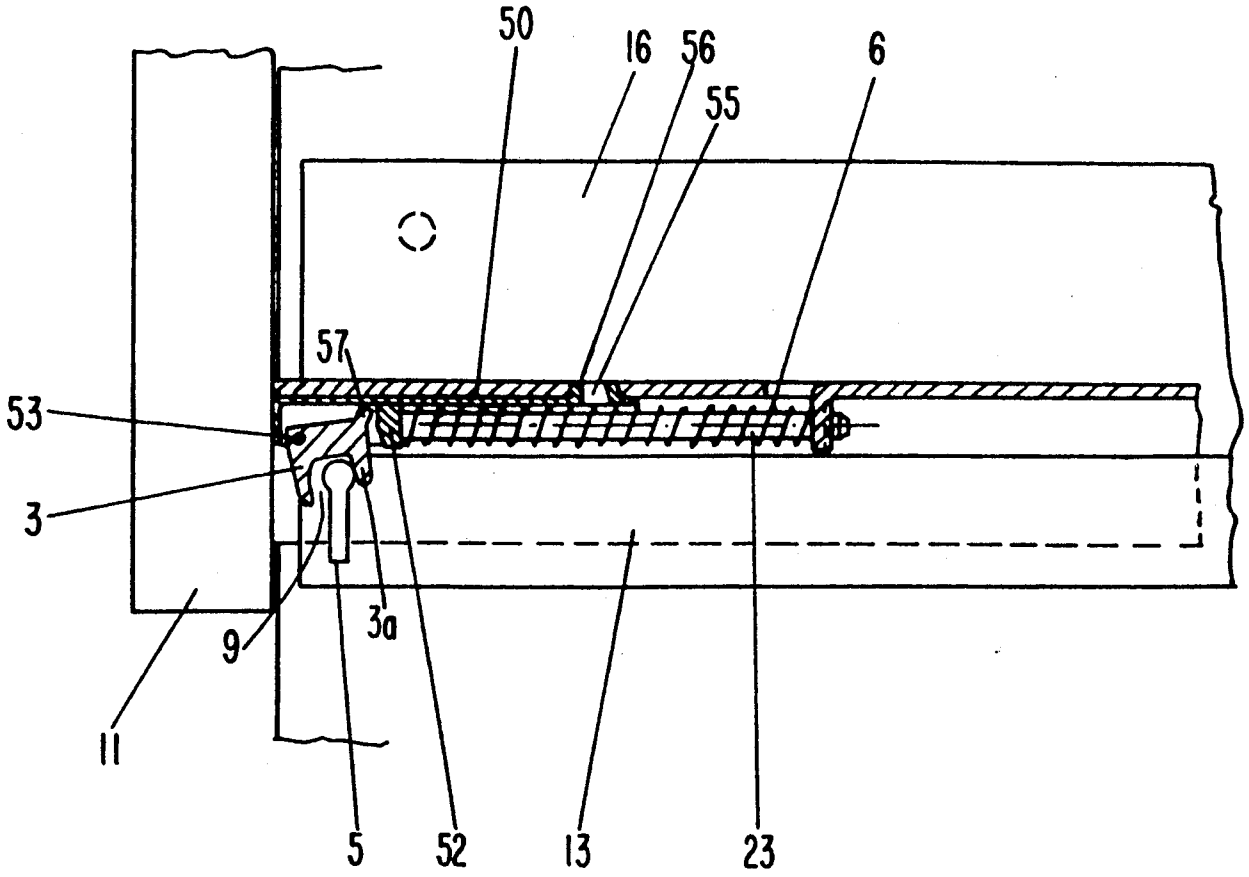
FIG. 33 is a view similar to FIG. 32, but showing the elements in the closed position of the drawer, similar to FIG. 27.
Figure 34:
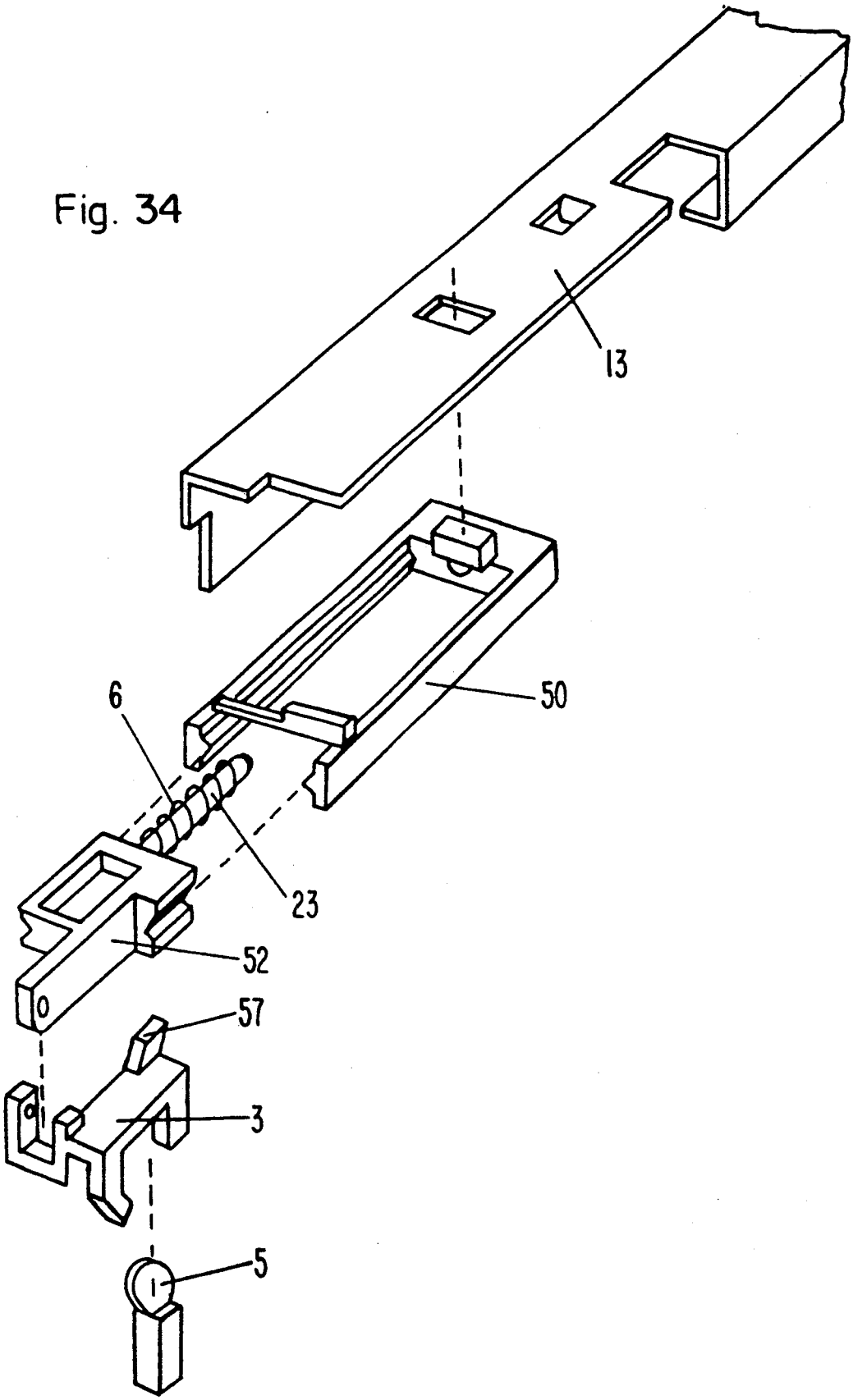
FIG. 34 is an exploded perspective view of the elements of the closing device according to this embodiment.

The operation of this embodiment of the present invention now will be described in detail, with particular reference to FIGS. 32 and 33. Thus, in the closed position of the drawer as shown in FIG. 33, spring 6 guided by guide rod 23 acts between slide member 52 and a downwardly bent tab of pull-out rail 13. If housing 50 has a rear abutment as shown in FIG. 34, the inner end of spring 6 also could act on such abutment portion of the housing. Since pin member 5 acts on tiltable member 3 to maintain it in the position shown in FIG. 33, the force of spring 6 acts rearwardly on pull-out rail 13/housing 50 to move such elements as well as the drawer inwardly of the furniture body to the fully inserted position. Particularly, the force of spring 6 acting on slide member 52 also acts on tiltable member 3 such that a leading surface of a first extension **3*a* of tiltable member 3 is abutted against pin member 5. When the drawer is pulled outwardly from such closed position, pin member 5 continues to retain tiltable member 3 in the position shown in FIG. 33. However, when the drawer, the pull-out rail 13 and the housing 50 move outwardly, this deforms, i.e. compresses in the example illustrated, spring 6. At such time as the housing 50 is moved outwardly to the predetermined relative position whereat recess 55 aligns with projection 57 of tiltable member 3, tiltable member 3 will tilt about axis 53 such that projection 57 will snap into recess 55, thereby locking tiltable member 3 to housing 50 and thereby to the drawer. This tilting action will occur due to the fact that the rearward edge of pin member 5 acts against a forward surface of extension 3*a* of tiltable member 3, while at the same time another force acts on tiltable member 3 at the axis 53. This will impart a tilting moment to tiltable member 3 in the counterclockwise direction as shown in FIG. 33. With tiltable member 3 locked in position relative to the drawer, the urging force of spring 6 is interrupted, and the drawer may be freely moved inwardly and outwardly of the furniture body, as long as such inward movement is not to an extent such that pin member 5 again is entered into catch slot 9. During the tilting movement, pin member 5 is withdrawn from slot 9, and particularly the lower edge of first extension 3*a* moves over pin member 5**.

When the drawer is moved inwardly to such an extent that pin member 5 again enters slot 9, then pin member 5 will contact a rearward surface of a second extension **3*b* of tiltable member 3, thereby causing tiltable member 3 to tilt about axis 53 such that projection 57 is withdrawn from recess 55. At that time, the urging force of spring 6 again is applied between slide member 52 and the pull-out rail or the housing. However, since pin member 5 retains tiltable member 3 and thereby slide member 52 in the position shown in FIG. 33, the force of spring 6 will urge the pull-out rail 13**/housing 50 rearwardly. This will cause the drawer to move into the furniture body to the fully inserted position.

In the embodiment of FIGS. 28–31, the spring acts between the slide member and the housing, and in the embodiment of FIGS. 33–34 the spring acts between the slide member and the pull-out rail. Either arrangement may be employed in either embodiment. Furthermore, the housing can be attached to the pull-out rail by any suitable means such as screws, or by means of punched-out tabs of the pull-out rail fitting through openings in the housing, or vice versa. Furthermore, guide rod 23 may be guided by the housing or by the pull-out rail. Furthermore, the fact that the housing is attached to a front portion of the pull-out rail enables ready accessibility in the event that correct tilting does not occur. The arrangement of the embodiments of FIGS. 26–34 allows a compact and space-saving assembly and easy installation and maintenance. Furthermore, although the spring 6 is illustrated in these embodiments as being a helical spring that is compressed and then expands to impart a restoring force, the arrangement could be the reverse such that the helical spring is expanded and then contracts to impart its restoring force.

Although the present invention has been described and illustrated with respect to preferred embodiments thereof, it is to be understood that various modifications and changes may be made to the specifically described and illustrated features without departing from the scope of the present invention. Furthermore, it is to be understood that various specific features described and illustrated with respect to one or more embodiments may be employed in all illustrated embodiments, unless otherwise so indicated.

What is claimed is:

1. A closing device, for use in an article of furniture having furniture components including a furniture body and a drawer slidable in opposite directions into and out of the furniture body, for moving the drawer to a fully inserted position within the furniture body, said closing device comprising:

a pin member adapted to be fixedly mounted on one of the furniture components;

a tiltable member adapted to be mounted on the other of the furniture components for displacement relative thereto in opposite first and second directions;

means providing engagement between said pin and tiltable members when the drawer is in the fully inserted position and thereby for causing, upon the drawer being moved in a direction outwardly of the furniture body, relative displacement in said first direction between said tiltable member and the other furniture component;

spring means, acting on said tiltable member and adapted to act on the other furniture component, for urging relative displacement in said second direction between said tiltable member and the other furniture component, and thereby for, when said pin and tiltable members are in engagement, urging the drawer to move in a direction inwardly of the furniture body to the fully inserted position; and means for, upon relative displacement between said tiltable member and the other furniture component against the urging force of said spring means in said first direction to a predetermined relative position, causing said tiltable member to tilt in a first pivot direction about an axis to a locking position whereat said tiltable member is locked in position with respect to the other furniture component and whereat engagement between said pin and tiltable members is released such that the drawer is freely movable into and out of the furniture body, and for, upon free movement of the drawer inwardly of the furniture body to a position whereat said pin and tiltable members again are engaged, causing said pin member to tilt said tiltable member in a second pivot direction about said axis away from said locking position, such that said urging force of said spring means again acts between said tiltable member and the other furniture component to thereby cause relative displacement therebetween in said second direction and to move the drawer in the direction inwardly of the furniture body to the fully inserted position.

2. A device as claimed in claim 1, wherein said pin member is to be mounted on the drawer, and further comprising means for mounting said tiltable member on the furniture body for movement relative thereto in said opposite first and second directions.

3. A device as claimed in claim 1, further comprising a guide track to be mounted on the other furniture component, and means for positioning said tiltable member for sliding movement in opposite directions along said guide track.

4. A device as claimed in claim 3, wherein said guide track defines a groove, and said positioning means extends from said tiltable member into said groove.

5. A device as claimed in claim 4, wherein said positioning means comprises a pair of guide rods.

6. A device as claimed in claim 5, wherein said groove has a T-shaped cross-sectional configuration, and said guide rods have portions with a substantially complementary T-shaped cross-sectional configuration retained in said groove.

7. A device as claimed in claim 3, wherein said guide track includes a rectilinear rear portion and an arcuate forward portion diverging laterally from the path of said rectilinear rear portion, said pin and tiltable members are engaged when said tiltable member is positioned along said rectilinear portion, and said tiltable member is moved to said locked position and released from engagement with said pin member when said tiltable member is positioned along said arcuate portion.

8. A device as claimed in claim 7, wherein said tiltable member has therein a slot, said pin member extends into said slot and is engaged with said tiltable member when said tiltable member is positioned along said rectlinear portion, and said pin member withdraws from said slot thereby releasing engagement between said pin and tiltable members when movement of said tiltable member along said arcuate portion causes said tiltable member to tilt to said locked position.

9. A device as claimed in claim 7, wherein said guide track includes arcuate portions at each of respective opposite ends of said rectilinear portion, whereby said device is employable on either of opposite sides of the drawer.

10. A device as claimed in claim 1, wherein said tiltable member has a portion with a U-shaped profile including spaced flanges, and said spring means is positioned between said flanges.

11. A device as claimed in claim 1, wherein said pin member is integral with a pull-out rail to be fastened to the drawer.

12. A device as claimed in claim 2, wherein said mounting means is formed with a member to be fastened to the furniture body.

13. A device as claimed in claim 12, wherein said member comprises an additional rail connected to a supporting rail to be connected to the furniture body.

14. A device as claimed in claim 12, wherein said member comprises a block connectable to a supporting rail to be fastened to the furniture body.

15. A device as claimed in claim 14, wherein said spring means comprises a pressure spring acting between said block and said tiltable member.

16. A device as claimed in claim 15, wherein said pin member is mounted on a pull-out rail to be connected to the drawer, and said pull-out rail has a stop to abut a counterstop of said tiltable member.

17. A device as claimed in claim 2, wherein said mounting means is attached to a supporting rail to be fastened to the furniture body.

18. A device as claimed in claim 2, wherein said tiltable member is provided with a bendable catch, separate from said engagement providing means, which is bendable by contact with said pin member upon inward movement of the drawer and which has a configuration to be abutted and pulled along by said pin member upon subsequent outward movement of the drawer.

19. A device as claimed in claim 1, wherein said axis extends horizontally.

20. A device as claimed in claim 1, wherein said axis extends vertically.

21. A device as claimed in claim 1, wherein said spring means comprises a helical spring that is compressed upon movement of said tiltable member in said first direction and that expands to impart said urging force.

22. A device as claimed in claim 1, wherein said spring means comprises a helical spring that is expanded upon of said tiltable member in said first direction and that retracts to impart said urging force.

23. A device as claimed in claim 1, wherein said pin member is to be mounted on the furniture body, and further comprising means for mounting said tiltable member on the drawer for movement relative thereto in said opposite first and second directions.

24. A device as claim in claim 23, wherein said pin member extends from a supporting rail to be fastened to the furniture body.

25. A device as claimed in claim 23, wherein said mounting means is mounted on a pull-out rail to be fastened to the drawer.

26. A device as claimed in claim 25, wherein said mounting means comprises a housing fixed to said pull-out rail and defining a rectilinear guide path, and a slide member slidable along said guide path in said opposite first and second directions, said tiltable member being pivoted to said slide member about said axis.

27. A device as claimed in claim 26, wherein said spring means is positioned between said housing and said slide member, whereby as the drawer is moved in the direction outwardly of the furniture body said housing moves outwardly with said pull-out rail, and said pin member engages said tiltable member to prevent movement thereof outwardly, thereby deforming said spring means.

28. A device as claimed in claim 27, wherein said housing has therein a recess at said predetermined relative position, and said tiltable member has extending therefrom a projection that extends into said recess upon said tiltable member tilting in said first pivot direction to said locked position.

29. A device as claimed in claim 28, wherein said tiltable member has therein a slot, said pin member extends into said slot and is engaged with said tiltable member before said predetermined position, and said pin member is withdrawn from said slot thereby releasing engagement between said pin an tiltable members when said tiltable member pivots about said axis to said locked position.

30. A device as claimed in claim 29, wherein said spring means is mounted on a guide rod.

31. A device as claimed in claim 30, wherein said axis is offset from said guide rod, and said pin member abuts an edge of said slot at a position tending to urge said tiltable member about said axis in said first pivot direction.

32. A device as claimed in claim 28, wherein said projection is hook-shaped and fits over a diverging edge of said recess.

33. In an article of furniture having furniture components including a furniture body and a drawer slidable in opposite directions into and out of said furniture body, and a closing device for moving said drawer to a fully inserted position within said furniture body, the improvement wherein said closing device comprises:

a pin member fixedly mounted on one of said furniture components;

a tiltable member mounted on the other of said furniture components for displacement relative thereto in opposite first and second directions;

means providing engagement between said pin and tiltable members when said drawer is in said fully inserted position and thereby for causing, upon said drawer being moved in a direction outwardly of said furniture body, relative displacement in said first direction between said tiltable member and said other furniture component;

spring means, acting on said tiltable member and on said other furniture component, for urging relative displacement in said second direction between said tiltable member and said other furniture component, and thereby for, when said pin and tiltable members are in engagement, urging said drawer to move in a direction inwardly of said furniture body to said fully inserted position; and means for, upon relative displacement between said tiltable member and said other furniture component against the urging force of said spring means in said first direction to a predetermined relative position, causing said tiltable member to tilt in a first pivot direction about an axis to a locking position whereat said tiltable member is locked in position with respect to said other furniture component and whereat engagement between said pin and tiltable members is released such that said drawer is freely movable into and out of said furniture body, and for, upon free movement of said drawer inwardly of said furniture body to a position whereat said pin and tiltable members again are engaged, causing said pin member to tilt said tiltable member in a second pivot direction about said axis away from said locking position, such that said urging force of said spring means again acts between said tiltable member and said other furniture component to thereby cause relative displacement therebetween in said second direction and to move said drawer in said direction inwardly of said furniture body to said fully inserted position.

34. The improvement claimed in claim 33, further comprising a guide track, mounted on said furniture body at a position corresponding to a latter half portion of the path of movement of said drawer out of said furniture body, for mounting said tiltable member on said furniture body for movement relative thereto in said opposite first and second directions.

35. The improvement claimed in claim 33, comprising respective said closing devices mounted on each of opposite first and second sides of said drawer at positions offset with respect to each other in the direction of movement of said drawer into said furniture body.

36. The improvement claimed in claim 35, further comprising, on each opposite side of said drawer, a pull-out guide assembly including a pull-out rail connected to said drawer and a supporting rail connected to the furniture body, and wherein each said pull-out rail has mounted thereon a respective said pin member, each said supporting rail has displaceably mounted thereon a respective said tiltable member, and said tiltable members on said opposite sides of said drawer are offset with respect to each other in said direction of movement of said drawer into said furniture body.

37. The improvement claimed in claim 36, wherein each said supporting rail includes upper and lower horizontal flanges, and each said tiltable member is mounted on the respective lower horizontal flange.

38. A closing device, for use in an article of furniture having furniture components including a furniture body and a drawer slidable in opposite directions into and out of the furniture body, for moving the drawer to a fully inserted position within the furniture body, said closing device comprising:

a first coupling member adapted to be fixedly mounted on one of the furniture components;

a second coupling member adapted to be mounted on the other of the furniture components for displacement relative thereto in opposite first and second directions;

means providing engagement between said first and second coupling members when the drawer is in the fully inserted position and thereby for causing, upon the drawer being moved in a direction outwardly of the furniture body, relative displacement in said first direction between said second coupling member and the other furniture component;

spring means, acting on said second coupling member and adapted to act on the other furniture component, for urging relative displacement in said second direction between said second coupling member and the other furniture component, and thereby for, when said first and second coupling members are in engagement, urging the drawer to move in a direction inwardly of the furniture body to the fully inserted position; and means for, upon relative displacement between said second coupling member and the other furniture component against the urging force of said spring means in said first direction to a predetermined relative position, causing said second coupling member to assume a locked position with respect to the other furniture component and whereat engagement between said first and second coupling members is released such that the drawer is freely movable into and out of the furniture body, and for, upon free movement of the drawer inwardly of the furniture body to a position whereat said first and second coupling members again are engaged, causing said first coupling member to release said second coupling member from said locked position such that said urging force of said spring means again acts between said second coupling member and the other furniture component to thereby cause relative displacement therebetween in said second direction and to move the drawer in the direction inwardly of the furniture body to the fully inserted position.

39. A device as claimed in claim 38, wherein said first coupling member comprises a pin member.

40. A device as claimed in claim 38, wherein said first coupling member is to be mounted on the drawer, and said second coupling member is to be mounted on the furniture body.

41. A device as claimed in claim 38, further comprising positioning means on said second coupling member and slidably mounted in a guide track, and means for locking said second coupling member on opposite ends of said guide track.

42. A device as claimed in claim 41, wherein said guide track defines a groove or slot, said positioning means extends from said coupling member into said groove or slot, and said locking means comprises at least one recess diverging laterally from said groove or slot.

43. A device as claimed in claim 42, wherein said groove or slot has at opposite ends thereof recesses diverging laterally therefrom.

44. A device as claimed in claim 42, wherein said positioning means comprises a pair of guide rods.

45. A device as claimed in claim 44, wherein said groove or slot has a T-shaped cross-sectional configuration, and said guide rods have portions with a substantially complementary T-shaped cross-sectional configuration retained in said groove or slot.

46. A device as claimed in claim 41, wherein said guide track includes a rectilinear rear portion and an arcuate forward portion diverging laterally therefrom, said second coupling member has therein a catch slot, said first coupling member extends into said catch slot and is engaged with said second coupling member when said second coupling member is positioned along said rectilinear portion of said guide track, and said first coupling member withdraws from said catch slot thereby releasing engagement between said first and second coupling members when movement of said second coupling member along said arcuate portion causes said second coupling member to assume said locked position.

47. A device as claimed in claim 46, wherein said guide track includes arcuate portions at each of respective opposite ends of said rectilinear portion and diverging laterally therefrom, whereby said device is employable on either of opposite sides of the drawer.

48. A device as claimed in claim 38, wherein said second coupling member has a portion with a U-shaped profile including spaced flanges, and said spring means is positioned between said flanges.

49. A device as claimed in claim 38, wherein said first coupling member is integral with a pull-out rail to be fastened to the drawer.

50. A device as claimed in claim 38, comprising mounting means for mounting said second coupling member on the furniture body for movement relative thereto in opposite first and second directions and formed with a member to be fastened to the furniture body.

51. A device as claimed in claim 50, wherein said member comprises an additional rail connected to a supporting rail to be connected to the furniture body.

52. A device as claimed in claim 50, wherein said member comprises a block connectable to a supporting rail to be fastened to the furniture body.

53. A device as claimed in claim 52, wherein said block is plastic.

54. A device as claimed in claim 52, wherein said block has a guide track.

55. A device as claimed in claim 52, wherein said spring means comprises a spring acting between said block and said second coupling member.

56. A device as claimed in claim 55, wherein said first coupling member is mounted on a pull-out rail to be connected to the drawer, and said pull-out rail has a stop to abut a counterstop of said second coupling member.

57. A device as claimed in claim 50, wherein said mounting means is attached to a supporting rail to be fastened to the furniture body.

58. A device as claimed in claim 57, wherein said mounting means has a guide track.

59. A device as claimed in claim 38, wherein said second coupling member is provided with a bendable catch, separate from said engagement providing means, which is bendable by contact with said first coupling member upon inward movement of the drawer and which has a configuration to be abutted and pulled along by said first coupling member upon subsequent outward movement of the drawer.

60. A device as claimed in claim 38, wherein said axis extends horizontally.

61. A device as claimed in claim 38, wherein said axis extends vertically.

62. A device as claimed in claim 38, wherein said spring means comprises a spring that is compressed upon movement of said second coupling member in said first direction and that expands to impart said urging force.

63. A device as claimed in claim 62, wherein said spring comprises a helical spring.

64. A device as claimed in claim 38, wherein said spring means comprises a spring that is expanded upon movement of said second coupling member in said first direction and that retracts to impart said urging force.

65. A device as claimed in claim 64, wherein said spring comprises a helical spring.

66. A device as claimed in claim 38, wherein said first coupling member is to be mounted on the furniture body, and further comprising means for mounting said second coupling member on the drawer for movement relative thereto in said opposite first and second directions.

67. A device as claimed in claim 66, wherein said first coupling member extends from a supporting rail to be fastened to the furniture body.

68. A device as claimed in claim 66, wherein said mounting means is mounted on a pull-out rail to be fastened to the drawer.

69. A device as claimed in claim 68, wherein said mounting means comprises a housing fixed to said pull-out rail and defining a rectilinear guide path, and a slide member slidable along said guide path in said opposite first and second directions, and said second coupling member being pivoted to said slide member about an axis.

70. A device as claimed in claim 69, wherein said spring means is positioned between said housing and said slide member, whereby as the drawer is moved in the direction outwardly of the furniture body said housing moves outwardly with said pull-out rail, and said first coupling member engages said second coupling member to prevent movement thereof outwardly, thereby deforming said spring means.

71. A device as claimed in claim 70, wherein said housing has therein a recess at said predetermined relative position, and said second coupling member has extending therefrom a projection that extends into said recess upon said second coupling member pivoting in a first pivot direction about said axis to assume said locked position.

72. A device as claimed in claim 71, wherein said second coupling member has therein a catch slot, said first coupling member extends into said catch slot and is engaged with said second coupling member before said predetermined position, and said first coupling member is withdrawn from said catch slot thereby releasing engagement between said first coupling and second coupling members when said second coupling member pivots about said axis to said locked position.

73. A device as claimed in claim 72, wherein said spring means is mounted on a guide rod.

74. A device as claimed in claim 73, wherein said axis is offset from said guide rod, and said first coupling member abuts an edge of said catch slot at a position tending to urge said second coupling member about said axis in said first pivot direction.

75. A device as claimed in claim 71, wherein said projection is hook-shaped and fits over a diverging edge of said recess.

76. A unit to be employed as part of a closing device, for use in an article of furniture having furniture components including a furniture body and a drawer slidable in opposite directions into and out of the furniture body, for moving the drawer to a fully inserted position within the furniture body, wherein the closing device is of a type include a first coupling member adapted to be fixedly mounted on one of the furniture components, said unit comprising:

a second coupling member adapted to be mounted on the other of the furniture components for displacement relative thereto in opposite first and second directions;

means for providing engagement of said second coupling member with the first coupling members when the drawer is in the fully inserted position and thereby for causing, upon the drawer being moved in a direction outwardly of the furniture body, relative displacement in said first direction between said second coupling member and the other furniture component;

spring means, acting on said second coupling member and adapted to act on the other furniture component, for urging relative displacement in said second direction between said second coupling member and the other furniture component, and thereby for, when said second coupling member is in engagement with the first coupling member, urging the drawer to move in a direction inwardly of the furniture body to the fully inserted position; and means for, upon relative displacement between said second coupling member and the other furniture component against the urging force of said spring means in said first direction to a predetermined relative position, causing said second coupling member to assure a locked position with respect to the other furniture component and whereat engagement of said second coupling member with the first coupling member would be released such that the drawer is freely movable into and out of the furniture body, and for, upon free movement of the drawer inwardly of the furniture body to a position whereat said second coupling member could be again engaged with the first coupling member, enabling said second coupling member to be released from said locked position such that said urging force of said spring means again acts between said second coupling member and the other furniture component to thereby cause relative displacement therebetween in said second direction and to move the drawer in the direction inwardly of the furniture body to the fully inserted position.

77. A unit as claimed in claim 76, wherein said second coupling member is to be mounted on the furniture body.

78. A unit as claimed in claim 76, further comprising positioning means on said second coupling member and slidably mounted in a guide track, and means for locking said second coupling member on opposite ends of said track.

79. A unit as claimed in claim 78, wherein said guide track defines a groove or slot, said positioning means extends from said second coupling member into said groove or slot, and said locking means comprises at lease one recess diverging laterally from said groove or slot.

80. A unit as claimed in clam 79, wherein said groove or slot has at opposite ends thereof recesses diverging laterally therefrom.

81. A unit as claimed in claim 79, wherein said positioning means comprises a pair of guide rods.

82. A unit as claimed in claim 81, wherein said groove or slot has a T-shaped cross-sectional configuration, and said guide rods have portions with a substantially complementary T-shaped cross-sectional configuration retained in said groove or slot.

83. A unit as claimed in claim 78, wherein said guide track includes a rectilinear rear portion and an arcuate forward portion diverging laterally therefrom, and said second coupling member has therein a catch slot to enable the first coupling member to be extended into said catch slot to engage with said second coupling member when said second coupling member is positioned along said rectilinear portion of said guide track, and whereby the first coupling member would be withdrawn from said catch slot to release engagement of said second coupling member with the first coupling member when movement of said second coupling member along said arcuate portion causes said second coupling member to assume said locked position.

84. A unit as claimed in claim 83, wherein said guide track includes arcuate portions at each of respective opposite ends of said rectilinear portion and diverging laterally therefrom, whereby said unit is employable on either or opposite sides of the drawer.

85. A unit as claimed in claim 76, comprising mounting means for mounting said second coupling member on the furniture body for movement relative thereto in opposite first and second directions and formed with a member to be fastened to the furniture body.

86. A unit as claimed in claim 85, wherein said member comprises a block connectable to a supporting rail to be fastened to the furniture body.

87. A unit as claimed in claim 86, wherein said block is plastic.

88. A unit as claimed in claim 86, wherein said block has a guide track.

89. A unit as claimed in claim 86, wherein said spring means comprises a spring acting between said block and said second coupling member.

90. A unit as claimed in claim 85, wherein said mounting means is attached to a supporting rail to be fastened to the furniture body.

91. A unit as claimed in claim 85, wherein said mounting means has a guide track.

92. A unit as claimed in claim 76, wherein said second coupling member is provided with a bendable catch, separate from said engagement providing means, which is bendable by contact with the first coupling member upon inward movement of the drawer and which has a configuration to be abutted and pulled along by the first coupling member upon subsequent outward movement of the drawer.

93. A unit as claimed in claim 76, wherein said spring means comprises a spring that is compressed upon movement of said second coupling member in said first direction and that expands to impart said urging force.

94. A unit as claimed in claim 93, wherein said spring comprises a helical spring.

95. A unit as claimed in claim 76, wherein said spring means comprises a spring that is expanded upon movement of said second coupling member in said first direction and that retracts to impart said urging force.

96. A unit as claimed in claim 95, wherein said spring comprises a helical spring.

97. A unit as claimed in claim 76, further comprising means for mounting said second coupling member on the drawer for movement relative thereto in said opposite first and second directions.

98. A unit as claimed in claim 97, wherein said mounting means is mounted on a pull-out rail to be fastened to the drawer.

99. A unit as claimed in claim 98, wherein said mounting means comprises a housing fixed to said pull-out rail and defining a rectilinear guide path, and a slide member slidable along said guide path in said opposite first and second directions, said second coupling member being pivoted to said slide member about an axis.

100. A unit as claimed in claim 99, wherein said spring means is positioned between said housing and said slide member, whereby as the drawer is moved in the direction outwardly of the furniture body said housing moves outwardly with said pull-out rail, and said second coupling member is adapted to be engaged by the first coupling member and prevented from movement outwardly thereby deforming said spring means.

101. A unit as claimed in claim 100, wherein said housing has therein a recess at said predetermined relative position, and said second coupling member has extending therefrom a projection that extends into said recess upon said second coupling member pivoting in first pivot direction about said axis to assume said locked position.

102. A unit as claimed in claim 101, wherein said second coupling member has therein a catch slot into which is to extend the first coupling member to engage with said second coupling member before said predetermined position and wherefrom the first coupling member is adapted to be withdrawn to thereby release engagement of said second coupling member when said second coupling member pivots about said axis to said locked position.

103. A unit as claimed in claim 102, wherein said spring means is mounted on a guide rod.

104. A unit as claimed in claim 103, wherein said axis is offset from said guide rod, such that the first coupling member is abuttable with an edge of said catch slot at a position tending to urge said second coupling member about said axis in said first pivot direction.

105. A unit as claimed in claim 101, wherein said projection is hook-shaped and fits over a diverging edge of said recess.

* * * * *